US006042342A

United States Patent [19]

Orian

[11] Patent Number: 6,042,342

[45] **Date of Patent: *Mar. 28, 2000**

[54] FLUID DISPLACEMENT SYSTEM

[75] Inventor: Itamar Orian, Tel-Aviv, Israel

[73] Assignee: T.D.I. —Thermo Dynamics Israel Ltd., Tel-Aviv, Israel

[ * ] Notice: This patent issued on a continued prosecution application filed under 37 CFR 1.53(d), and is subject to the twenty year patent term provisions of 35 U.S.C. 154(a)(2).

[21] Appl. No.: 08/725,321

[22] Filed: Oct. 2, 1996

[51] Int. Cl.[7] ..... F04B 19/24

[52] U.S. Cl. ..... 417/207; 417/208; 417/118; 60/369; 91/4 R

[58] Field of Search ..... 417/92, 118, 207, 417/208; 60/369, 643, 682; 91/4 R

[56] References Cited

U.S. PATENT DOCUMENTS

| | | |
|---|---|---|
| 2,738,928 | 3/1956 | Lieberman . |
| 3,484,045 | 12/1969 | Waters . |
| 3,929,305 | 12/1975 | Sabol . |
| 4,021,147 | 5/1977 | Brekke . |
| 4,177,019 | 12/1979 | Chadwick . |
| 4,197,060 | 4/1980 | Chadwick . |
| 4,246,890 | 1/1981 | Kraus et al. . |
| 4,270,521 | 6/1981 | Brekke . |
| 4,366,853 | 1/1983 | Bernier . |
| 4,467,862 | 8/1984 | DeBeni . |
| 4,478,211 | 10/1984 | Haines et al. . |
| 4,552,208 | 11/1985 | Sorensen . |
| 4,573,525 | 3/1986 | Boyd . |
| 4,611,654 | 9/1986 | Buchsel . |
| 4,676,225 | 6/1987 | Bartera . |
| 5,351,488 | 10/1994 | Sorensen . |
| 5,452,580 | 9/1995 | Smith . |

*Primary Examiner*—Charles G. Freay
*Assistant Examiner*—Cheryl J. Tyler
*Attorney, Agent, or Firm*—Oliff & Berridge, PLC

[57] ABSTRACT

In a fluid displacement system having a pressure vessel, an expansion vessel, first and second tubes in fluid communication with the two vessels, and an energy source, fluid contained within the system is transferred from one vessel to the other by activating the energy source, which in turn generates pressure in the pressure vessel. The generated pressure in the pressure vessel, in turn, displaces the fluid in the expansion vessel, and the system advantageously has no moving parts.

38 Claims, 14 Drawing Sheets

FLUID DISPLACEMENT SYSTEM

FIELD OF THE INVENTION

The present invention is in the field of fluid displacement systems and more specifically it is concerned with a system useful as a cyclic fluid pulse generator. By another aspect of the invention, the system is useful also as a fluid flow rectifier.

BACKGROUND OF THE INVENTION AND PRIOR ART

Fluid displacement systems with which the present invention is concerned are at times referred to as "passive" or "self-pumping pump system", "geyser-type pump systems", "heat" or "thermal actuated pump systems" etc. However, heretofore prior art systems in the related field typically comprise mechanical or electromechanical components such as pumping means, valves etc, which require control means and an energy source and which in many cases are suitable only for liquids and are not suitable for handling gas or vapor or a combination of gas or vapor and liquid. Furthermore, such mechanical components require periodical maintenance and replacing due to wear.

The following is a brief description of some prior art references which are in the related field and from which the present invention is clearly distinguishable:

U.S. Pat. No. 4,573,525 discloses a heat actuated heat exchange system comprising a conduit in a primary heating zone, a boiler in a second heating zone and an accumulator in a third heating zone, connected by another conduit zone to a condenser two check valves and a heat rejector, forming together a sealed device containing a condensable coolant.

The drawbacks of this patent are that it requires heat as an energy source which heat must be effected to three different stages of the device. Furthermore, the system requires two check valves for ensuring fluid flow in desired direction only. It is also apparent that the system will not function unless it is sealed.

U.S. Pat. No. 4,552,208 discloses an apparatus for circulating a heat transfer liquid from a heat collector such as a solar collector panel, to a heat exchanger such as heat storage means. However, this device is level-dependant and will operate only if the heat exchanger is located at a level below that of the heat collector.

U.S. Pat. No. 4,478,211 is a "geyser-type" heat exchanger which depends on the production of differences in liquid levels so as to create sufficient hydrostatic pressure imbalance for promoting flow of a heated liquid.

The liquid displacing forces in the '208 and '211 are limited by the elevation differences between the inlet and the outlet of the heated liquid connecting tube.

The heat exchange system disclosed in U.S. Pat. No. 3,929,305 comprises a reservoir for a coolant liquid conveyed via a conduit through a heating zone and a check valve for preventing a reverse flow in the conduit. Apart from the fact that this system requires a check valve, it is also sensitive to the heat applied to the system, and the cycle under which the device operates resembles the generative cycles of Sterling or Ericson engines.

U.S. Pat. No. 2,738,928 discloses a sealed heat exchange system having an internal pumping mechanism consisting of a heat separator in which dimensions of the associated components are critical in order to keep the system in balance. Moreover, the system relies on a connecting tube extending between a heating vessel and a distribution, said connecting tube being of a capillary caliber in order to ensure liquid level rise within the tube, regardless of any other factors. This arrangement ensures that the opening of the connecting tube is sealed within the heating vessel is always sealed by the capillary rise of liquid within the tube, owing to the surface tension force acting between the tube's lowermost edge and the liquid within the heating vessel. For that reason, the opening of the connecting tube is typically flared i.e, bell-like shaped. It thus appears that the system according to that patent is operable only with liquids as a working fluid, and not with gases.

Other references which are in the field of the invention are U.S. Pat. Nos. 3,484,045; 4,177,019; 4,197,060; 4,246,890; 4,270,521; 4,366,853; 4,467,862; 4,611,654; and 4,676,225 each of which shares one or more of the drawbacks disclosed in the above disclosed patents and are thus considered to be distinguishable.

It is an object of the present invention to provide a new and improved, self activated fluid displacement system, devoid of any mechanical or electromechanical components and in which the above-referred to drawbacks are substantially reduced or overcome.

SUMMARY OF THE INVENTION

According to the present invention there is provided a fluid displacement system comprising a pressure vessel, an expansion vessel, first and second tubes being each in flow communication with the two vessels, fluid contained within the system, and an energy source for generating pressure in said pressure vessel; said first tube having a first opening within said pressure vessel, a second opening within said expansion vessel, and tube sections extending between said first and said second openings connected to one another by a first intermediate section; said second tube having a third opening at a bottom portion of said pressure vessel and a fourth opening within said expansion vessel; said first opening being above said third opening; wherein at a rest stage of the system, prior to activating the energy source, the fluid level within the vessels exceeds at least one of the first and second opening and at least one of the third and fourth opening. In most embodiments of the invention the fluid is a liquid and the energy source is a pressure source applying direct pressure to the pressure vessel or a heat source which by heating the fluid causes a pressure raise within the pressure vessel.

Pressure rise in the pressure vessel expels the liquid from it until liquid level drops below the lowermost portion of the first tube whereby gas or vapor escape through the first tube, thus creating bubbles in the vertical portions thereof and eventually evacuating the first tube. The specific gravity difference of liquid columns in tube portions within the vessels, induces spontaneous liquid flow in the second tube in a reversed direction, whereby bubble flow via the first tube is increased and the system returns to its initial stage.

By a first application of the present invention, the system is useful as a cyclic fluid pulse generator, wherein a second intermediate section extends between said third and said fourth openings, said second intermediate section being below said first intermediate section.

When the system is used as a cyclic fluid pulse generator, there exists a working stage of the system wherein the fluid level in the expansion vessel is higher than fluid level in the pressure vessel; the difference in height being such that once liquid is cleared from said first tube to an extent to allow gas communication between the two vessels, there is a pressure head sufficient to overcome flow losses in said second tube so as to allow reverse flow of liquid therethrough up to a level equal to or above said first opening.

By a second application of the invention, the system is used as a liquid flow rectifier, wherein the tube sections of the first tube extend downwards from the first and second openings and said first intermediate section is a lowermost section, said second opening is at the bottom of the expansion vessel and said fourth opening is positioned above said second opening. In a specific embodiment of a flow rectifier according to the present invention the fourth opening is essentially at the same level as the first opening.

By a modification of the first application, where the system is used as a cyclic fluid pulse generator, the expansion vessel is sealed and it comprises a fluid outlet connected to a cylinder with a piston reciprocally retained therein, whereby linear reciprocal motion is obtained. Optionally, the piston is linked to a crank shaft for converting linear reciprocating motion of the piston into circular motion. Because the expansion vessel is sealed in this embodiment, the energy source in this embodiment cannot be a pressure source that introduces gas into the system.

Preferably, the expansion vessel further comprises a pressure reducing system such as a condenser, for improving condensation of a vapor retained therein.

By still a further modification of the first application, the system is used as a compressor or a pump, wherein the piston sealingly divides the cylinder into a first and a second chamber, said first chamber being in flow communication with the expansion vessel and said second chamber comprising a first check valve for fluid inlet and a second check valve for pressurized fluid outlet. However, instead of a piston, an immiscible liquid may be used.

According to another embodiment of the present invention, the system is used as an energy meter, for measuring heat exchange between a heat source extending through the pressure vessel thus constituting the energy source, and a cold source extending through the expansion vessel for facilitating vapor condensation; the system vessel further comprises a counting unit activated by an activator displaceable upon change in fluid level; the tube sections of the first tube extend downwards from the first and second openings and said first intermediate section is a lowermost section. In a specific embodiment the counting unit is placed within the expansion vessel.

By specific embodiments of the energy meter according to the invention the actuator is a float member having a conductive portion for closing an electric circuit of the counting unit. Alternatively, the actuator is a float member having an inductive portion for magnetically activating the counting unit or, a float member adapted for mechanically activating said counting unit e.g, by a toggle switch.

The system according to the present invention may also be used as a liquid pump, wherein a cyclic fluid pulse generator is used in conjunction with a flow rectifying arrangement, wherein the flow rectifying arrangement is a flow rectifier in accordance with the second embodiment of the present invention.

In accordance with one embodiment of a liquid pump according to the invention, the expansion vessel of a cyclic fluid pulse generator is in flow communication with the pressure vessel of the flow rectifier, allowing gas transfer only. Preferably, there is provided a siphon-like arrangement connecting the expansion vessel of the cyclic fluid pulse generator and the pressure vessel of the flow rectifier for assuring gas transfer only.

According to another embodiment of a liquid pump according to the invention, the second tube of the cyclic fluid pulse generator is in flow communication with a bottom portion of the pressure vessel of the flow rectifier. Optionally, the expansion vessel of the cyclic fluid pulse generator comprises an airing port, or a chamber useful as an accumulator for a closed system.

Still another application of the invention is a self priming boiler wherein steam is provided to a steam operated system (e.g. a steam engine, etc.) from the pressure vessel of a fluid pulse generator, there being a cold liquid source connected to the expansion vessel via a check valve, allowing flow only into the expansion vessel. By a specific application the steam flows from the steam operated system, via condenser into the cold liquid source.

A liquid pump may be obtained by using a flow rectifying arrangement consisting of two check valves positioned in series with the cyclic fluid pulse generator.

A liquid pump with which the invention is concerned may be useful for circulating liquid between a liquid heating device and a heat consumer, wherein the energy source is a temperature difference between an inlet and an outlet of the pump.

By another application of the invention there is provided a low pressure circulating pump with an integral accumulator, wherein the second tube of the system is parallely connected to a cooling unit, the arrangement being such that fluid flows from the pressure vessel via a flow rectifier to the cooling unit and then cool liquid flows into the expansion vessel and via a second flow rectifier back to the pressure vessel.

The liquid pump may also be applicable for circulating a liquid coolant agent of an engine, wherein heat emitted from the engine is used as the energy source.

The system according to the present invention may also be useful as a gas flow rectifier wherein the vessels and the tubes are inverted and whereby the first and second tubes each comprise tube sections extending upwardly from the first, second, third and fourth openings respectively, the respective tube sections being connected by uppermost intermediate sections; wherein at the rest stage of the system, the fluid level within the vessels at least exceeds the second and the third openings but does not reach the first and fourth openings.

By still another application of the invention, there is provided a liquid displacing system comprising a cyclic fluid pulse generator operable with a first liquid having a low boiling temperature; and a flow rectifier operable with a second liquid having a high boiling temperature; the fluid pulse generator being in flow communication with the flow rectifier via a first pipe connecting the expansion vessel of the fluid pulse generator with the pressure vessel of the flow rectifier; and a second tube extending from a bottom portion at the pressure vessel of the flow rectifier into a heating unit, via a first heat exchanger within the pressure vessel of the fluid pulse generator, then via a second heat exchanger within the expansion vessel of the fluid pulse generator and returning into the expansion vessel of the flow rectifier, at a top portion thereof.

BRIEF DESCRIPTION OF THE DRAWINGS

For better understanding, the invention will now be described by way of selected embodiments, in a non-limited manner and with reference to the accompanying drawings, in which.

DETAILED DESCRIPTION OF SPECIFIC EMBODIMENTS

Figure 1A:
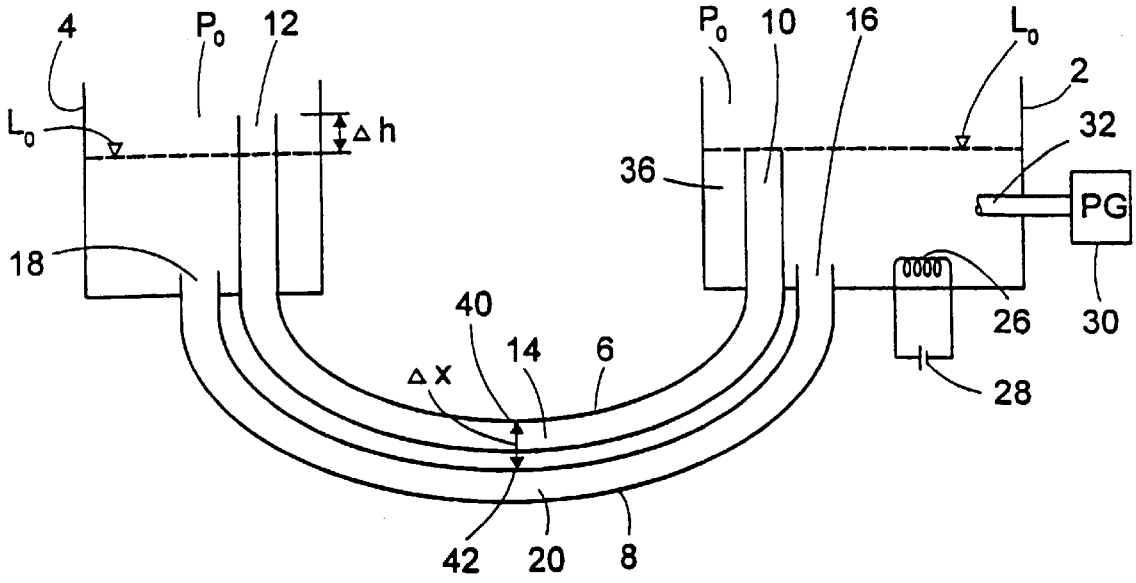
FIGS. 1*a*–1*d* are schematic illustrations of a basic configuration of a cyclic fluid pulse generator according to the present invention, in four different operative stages.
Figure 1B:
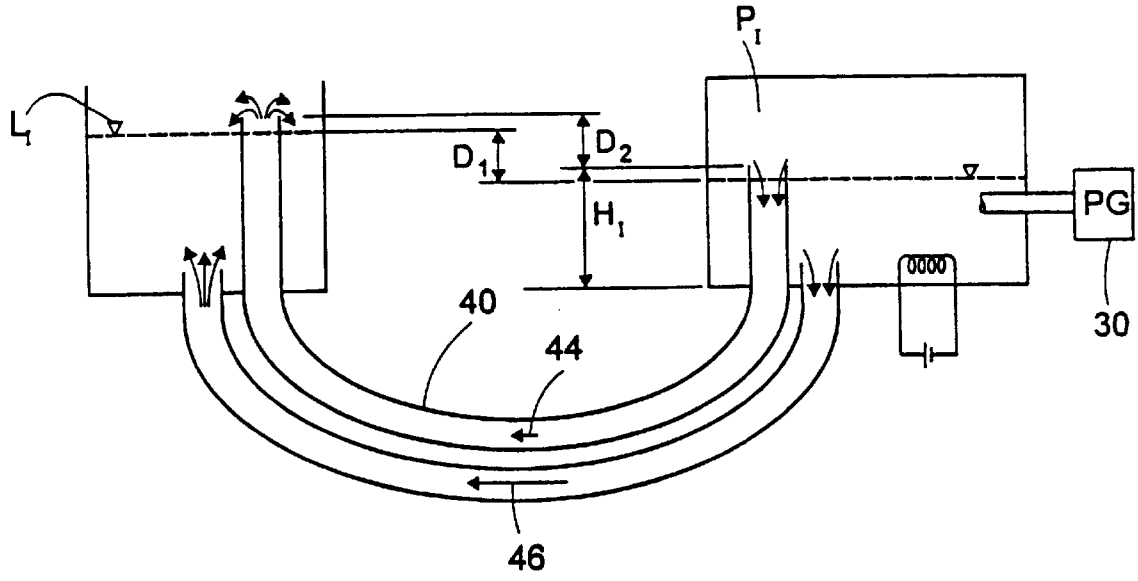
Figure 1C:
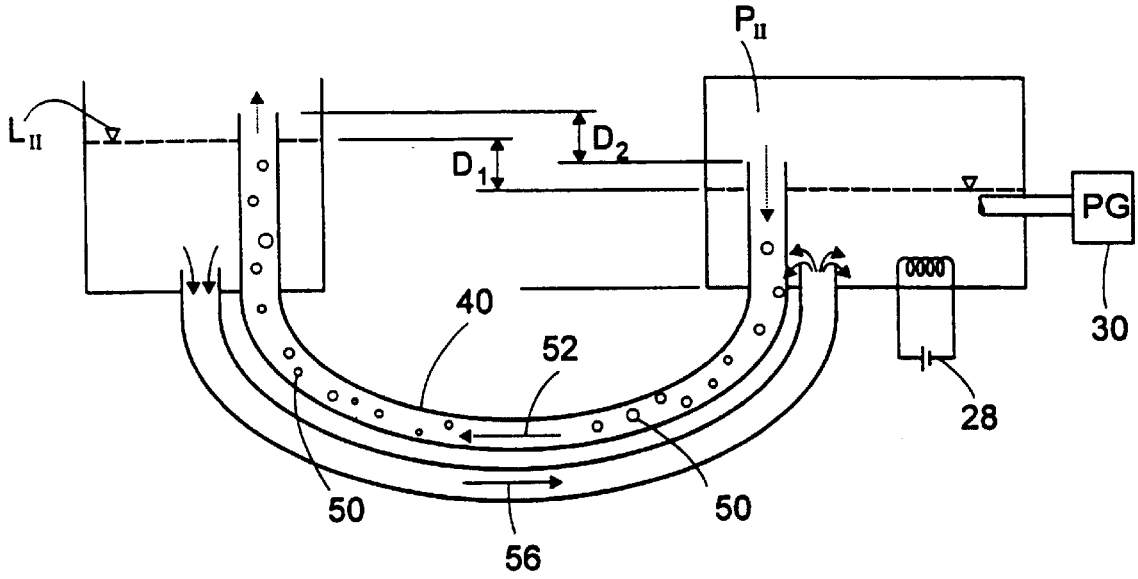
Figure 1D:
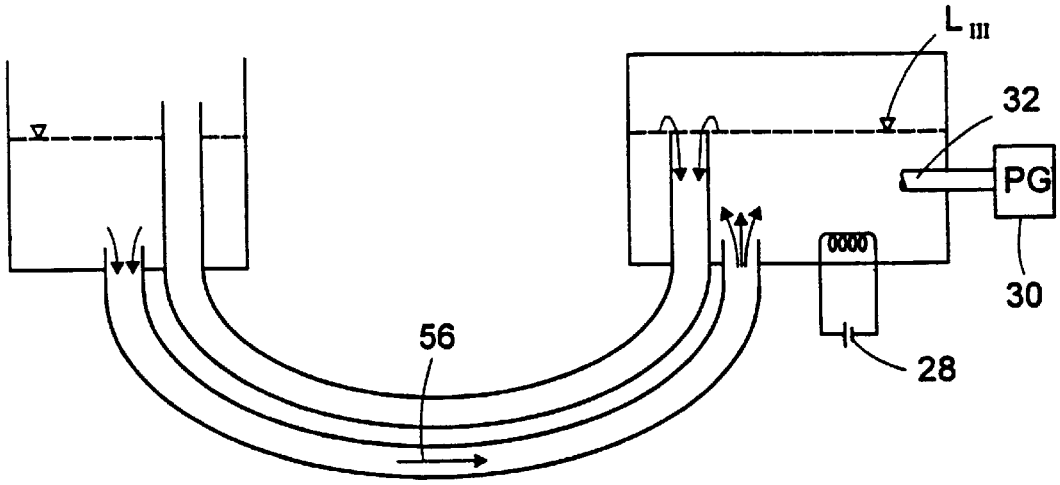
Figure 2A:
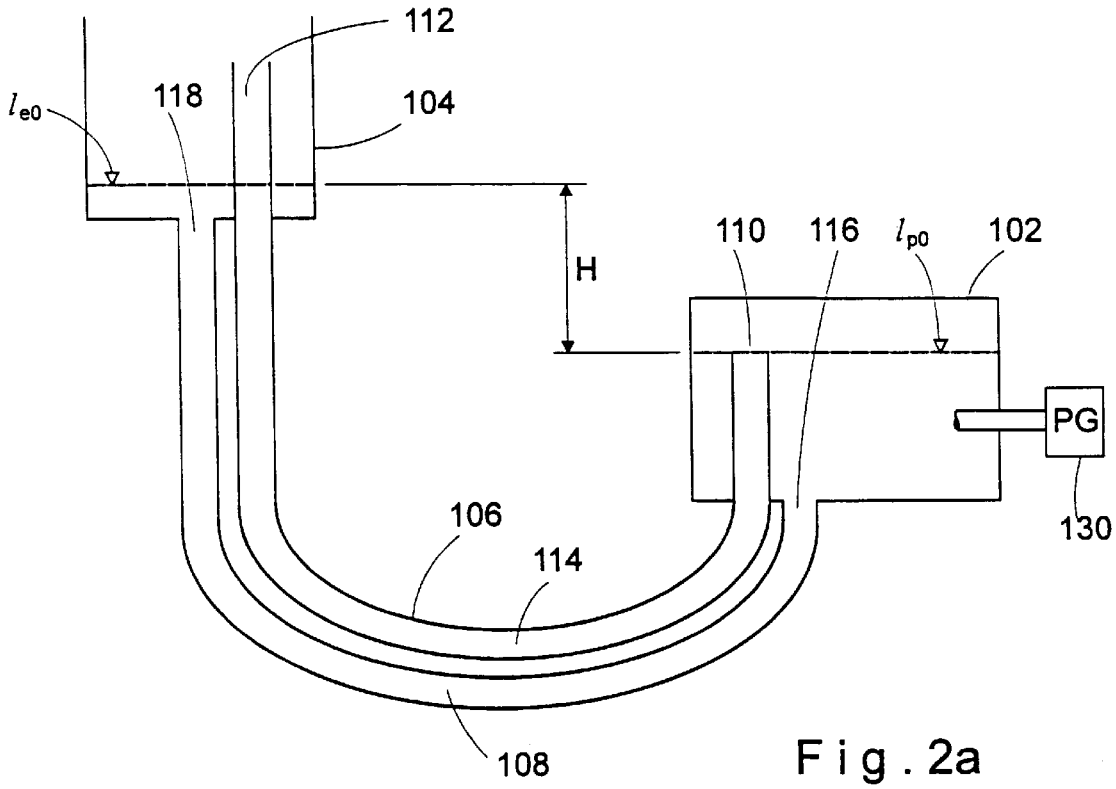
FIGS. 2*a*–2*d* are schematic illustrations of an embodiment of a cyclic fluid pulse generator according to the present invention, in four different operative stages.
Figure 2B:
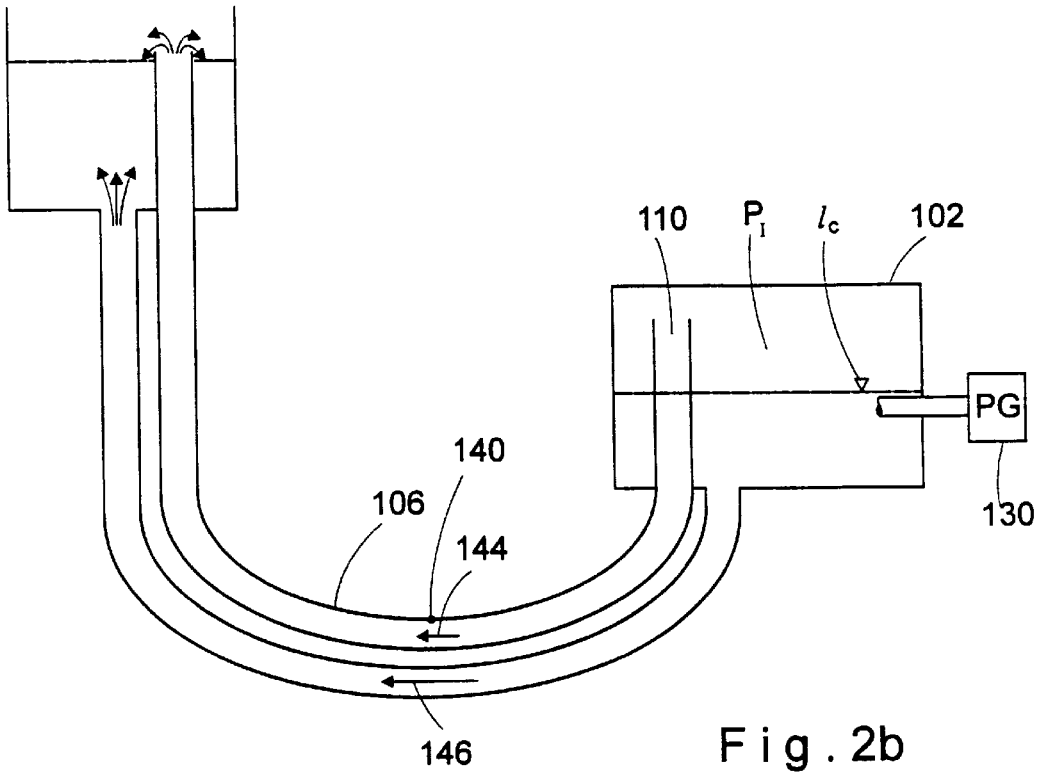
Figure 2C:
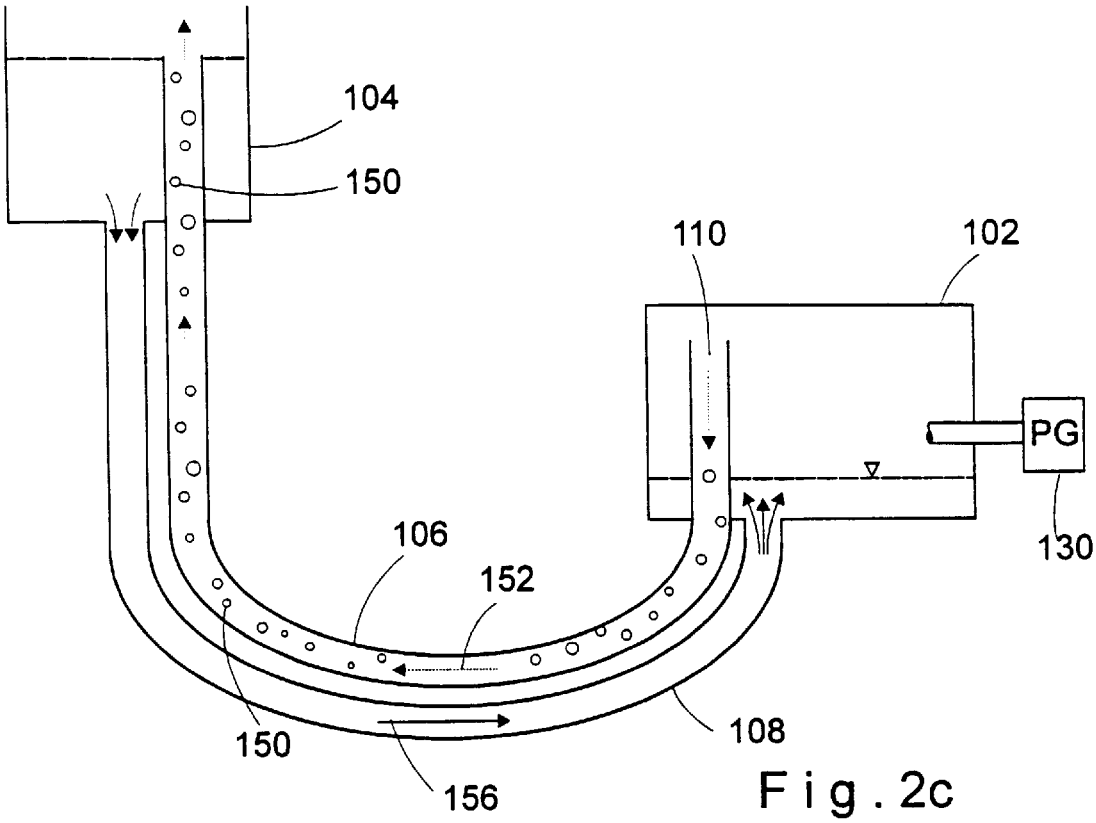
Figure 2D:
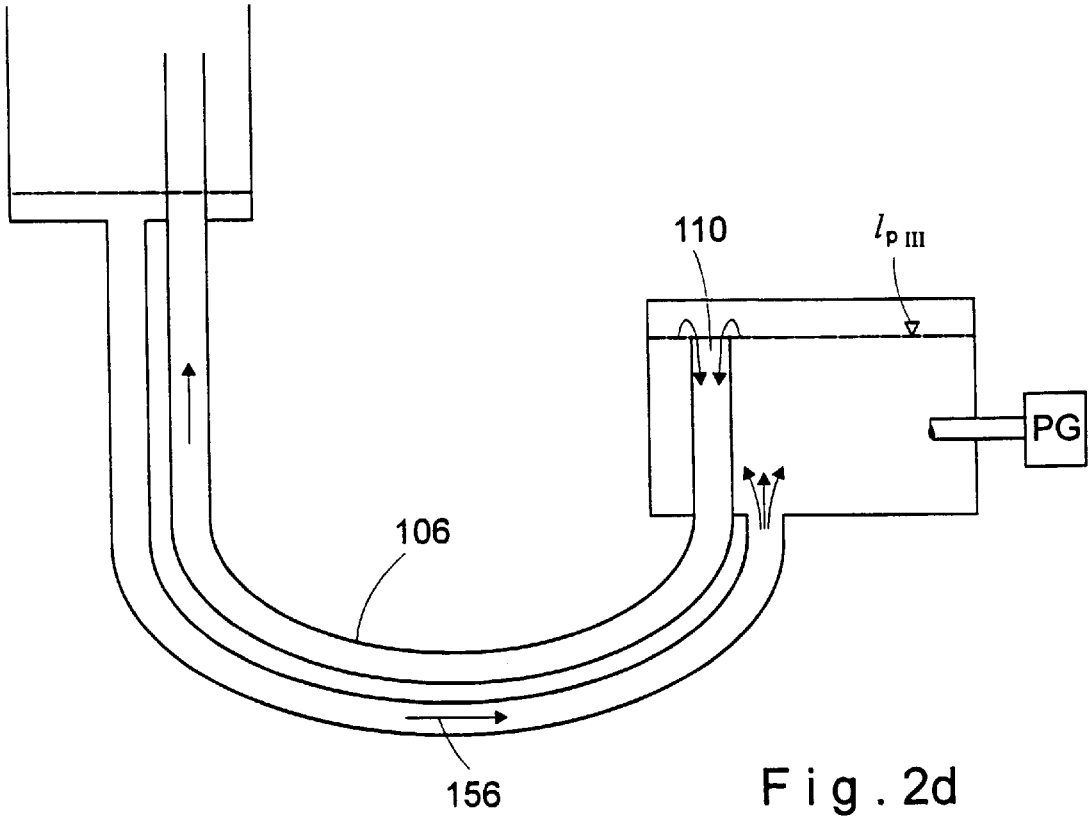

Attention is first directed to FIGS. 1(*a*) to 1(*d*) of the drawings for understanding the basic principles of the present invention, which as will be hereinafter explained, are applicable for all the applications and embodiments of the invention.

The system consists of a pressure vessel 2 and an expansion vessel 4, the vessels being connected to one another by a first tube 6 and a second tube 8, both tubes having an essentially U-like shape.

The first tube 6 has a first opening 10 within the pressure vessel 2 and a second opening 12 within the expansion vessel 4, with a lowermost portion 14 therebetween. The second tube 8 has a third opening 16 within the pressure vessel 2 and a fourth opening 18 within the expansion vessel 4, with a lowermost portion 20 therebetween. As can further be seen in the drawings, the first opening 10 is somewhat lower than the second opening 12 but extends at a noticeable height above the third and fourth openings 16 and 18 which extend adjacent the bottom portions of the vessels 2 and 4, respectively.

The system further comprises a pressure increasing means which in the present example is a heating element 26 connected to a power source 28. Additionally, or instead, there is provided a gas pressure generator (compressor) 30 for increasing the pressure in the pressure vessel, via tube 32. In various embodiment of the invention used as example herein, the pressure generator can be, for example, a fluid heating element or a compressor, which ever is appropriate for use with a particular embodiment.

The system is filled with a liquid 36, and as seen in FIG. 1(*a*), at an initial stage both vessels 2 and 4 are filled with liquid at pressure $P_0$, which owing to rule of connected vessels extends at the same level $L_0$ in both vessels 2 and 4. The first, third and fourth openings 10, 16 and 18, respectively, are immersed in the liquid, whereas the second opening 12 extends above the liquid level $L_0$ at a height $\Delta h$ which is smaller than the height difference $\Delta X$ measured between the highest point 40 of the first lowermost portion 14 (first tube 6) and the highest portion 42 of the second lowermost portion 20 (second tube 8).

Further reference is made to FIG. 1(*b*) wherein a cycle of operation of the system above described begins with increasing the pressure in the pressure vessel 2 by either or both raising the temperature of the liquid 36 by the heat element 26 and/or by applying pressure by the pressure generator 30. As the pressure in the pressure vessel 2 reaches pressure $P_I$, liquid flows via tubes 6 and 8 in direction of arrows 44 and 46 respectively (small arrow resembling small amounts, large arrow resembling large amounts), raising the liquid level in the expansion vessel 4 to level $L_I$.

It is obvious that owing to area difference between the pressure vessel 2 and the first tube 6, once liquid level in the pressure vessel 2 has dropped beneath height $H_I$ of the first opening 10, the amount of liquid flowing via the second tube 8 is essentially larger than that flowing via the first tube 6.

At a further stage of the cycle, as illustrated in FIG. 1(*c*), when pressure in the pressure vessel 2 increases to $P_{II}$, fluid level in the pressure vessel continues to decrease until it reaches the critical height 40 (highest point at the first lowermost portion 14 of the first tube 6), at which vapor enters the first tube 6 and vapor bubbles 50, flowing in direction of arrow 52 (dashed arrow resembling vapor flow), evacuate liquid from the first tube 6. The presence of vapor or gas bubbles in the liquid contained within the first tube 6, lowers the specific gravity of the liquid-bubble mixture in the first tube below that of the pure liquid contained within the second tube 8. When liquid level $L_{II}$ in the expansion vessel 4, being higher than the liquid level in the pressure vessel 2, the difference of specific gravity in the liquid columns, having equal length $D_1=D_2$ (as illustrated in FIGS. 1*b* and 1*c*), induces spontaneous liquid flow in the second tube 8 in a reversed direction i.e, in direction of arrow 56, whereby gas or bubble flow via the first tube is increased, the system returns to its initial stage. The term "flip" as used in the description designates the spontaneous, gravity induced change of liquid flow direction within the second tube 8.

The final stage of the cycle, illustrated in FIG. 1(*d*) takes place when fluid level in the pressure vessel 2 reaches level $L_{III}$ which is the height $H_I$ of the first opening 10, where once again liquid fills the first tube 6, returning the system to its initial stage. A new cycle will occur upon raising the pressure in the pressure vessel 4, as explained hereinabove.

Attention is now directed to FIGS. 2(*a*) to 2(*d*), schematically illustrating a different embodiment of a cyclic fluid pulse generator system. For the sake of clearance and understanding, those elements which are principally similar to those described with reference to FIGS. 1(*a*) to 1(*d*) are designated by the same reference number with the additional offset of one hundred.

A pressure vessel 102 is connected to an open expansion vessel 104 via a first tube 106 and a second tube 108 below the first tube. The first tube has a lowermost portion 114 and comprises a first opening 110 within the pressure vessel 102 and a second opening 112 within the expansion vessel 104. The second tube 108 has a third opening 116 within the pressure vessel and a fourth opening 118 within the expansion vessel. Pressure vessel 102 further comprises pressure raising means 130, which in the present embodiment is a pressure generator (a compressor), but as can be understood, may also be suitable liquid heating means, as explained in connection with the first embodiment.

As can further be seen in FIG. 2(*a*), the expansion vessel 104 is positioned above the pressure vessel 102 and the difference in fluid level H between liquid level $L_{p0}$ in the pressure vessel 102 and liquid level $L_{e0}$ in the expansion vessel 104, may be determined according to minimal pressure head sufficient to overcome flow losses in the second tube 108, so as to allow liquid flow up to a level at least equal to the level of the first opening 110, as will hereinafter be explained.

As seen in FIG. 2(*b*), Upon applying pressure $P_I$ in the pressure vessel 102 by the pressure generator 130, liquid flows via the first and second tubes 106 and 108 in directions of arrows 144 and 146, respectively. As soon as liquid level within the pressure vessel 102 reaches the critical level lc (the uppermost point 140 at the lowermost portion 114 of the first tube 106), vapor will enter the first tube 106 (see FIG. 2(*c*)) and vapor bubbles 150 flowing in the direction of dashed arrow 152 will expel liquid from the first tube to the expansion vessel 104, entailing occurrence of the "flip ", whereby liquid under influence of different static pressure heads begins to flow in reverse direction in the second tube 108, as illustrated by arrow 156. As soon as liquid level in the pressure vessel 102 reaches level $I_{pIII}$ (at the height of the first opening 110) it fills up the first tube 106, preventing further gas or vapor flow from the pressure vessel to the expansion vessel, thus ending the cycle (see FIG. 2*d*). The system is again ready for a new cycle to take place upon pressure increase in the pressure vessel 102.

FIGS. 3 to 8 schematically illustrate different practical applications of the system according to the present invention.

Figure 3A:
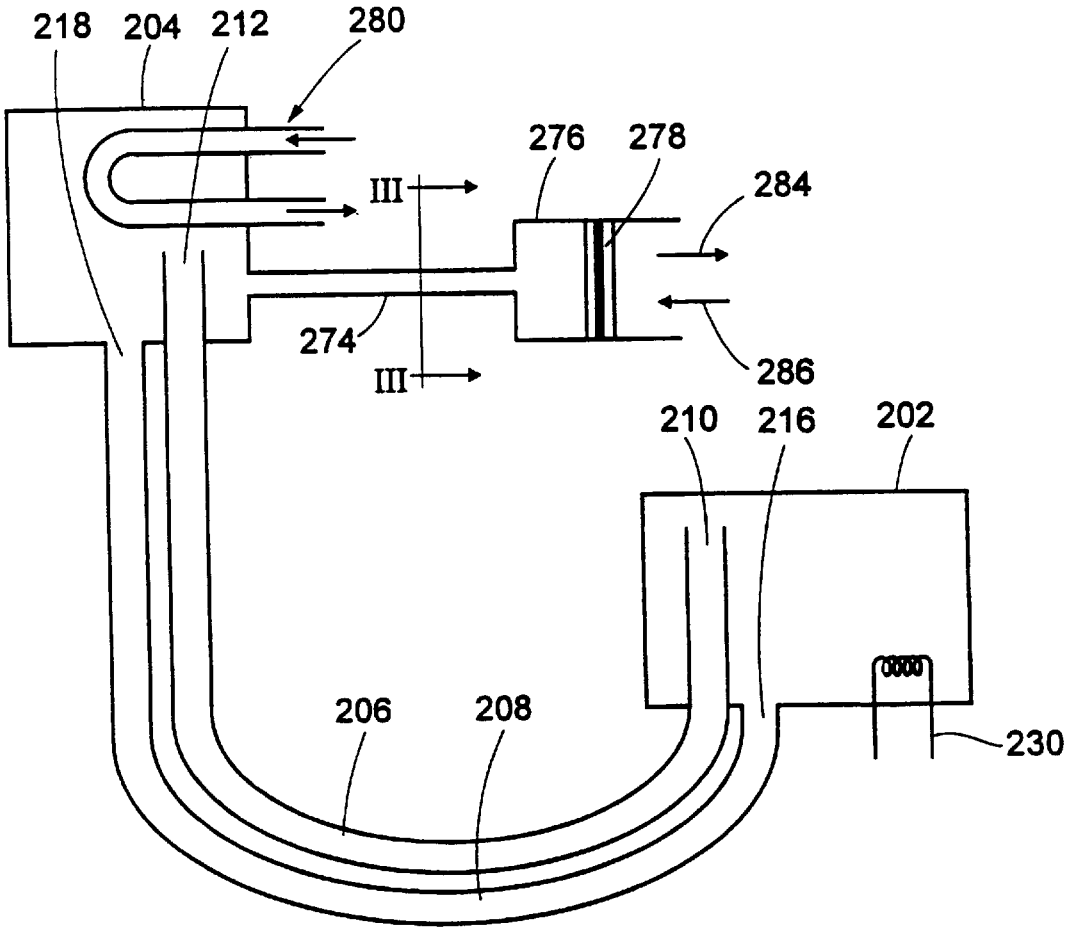
FIG. 3*a* is a schematic illustration of an application of the fluid displacement system according to the present invention, used as an engine with a pulsating piston for obtaining reciprocal linear or rotary motion.
Figure 3B:
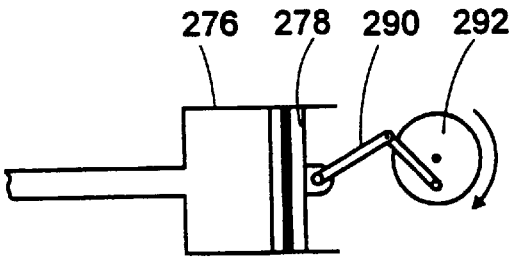
FIG. 3*b* is a partial view along line III—III in FIG. 3*a*, schematically illustrating how the fluid displacement system may be used for obtaining circular motion.

FIG. 3(*a*) illustrates how the system may be used for obtaining mechanical work i.e, as an engine. The system comprises among others, the basic components as illustrated in the embodiment illustrated in FIGS. 1(*a*) to 1(*d*) and thus, for the sake of clearance and understanding, those elements which are principally similar are designated by the same reference numerals with additional offset of two hundred.

As seen, the system consists of a pressure vessel 202 and a sealed expansion vessel 204 connected to one another by a first and a second tube 206 and 208, respectively, the first tube having first and second openings 210 and 212 in the pressure vessel and expansion vessel, respectively and the second tube 208 has third and fourth openings 216 and 218, in the pressure vessel and expansion vessel, respectively. The tubes are configured as hereinabove explained with respect to the embodiment discussed with reference to FIGS. 2(*a*) to 2(*d*). The system also comprises a pressure generating member 230. When the expansion vessel 204 is sealed and not vented, the pressure generating member 230 is a heat source.

As can further be seen, the expansion vessel 204 is connected via tube 274 to a cylinder 276 accommodating a piston 278 adapted for linear reciprocal displacement as known per se. The system also comprises a pressure reducing unit 280, e.g, a heat exchanger coil or a vent, wherein in the case of a heat exchanger, chilled fluid flows through the coils as known in the art.

The arrangement is such that a pressure pulse within the expansion vessel 204 (see explanation relating to FIG. 2(*b*), above) entails a pressure pulse also in the cylinder 276 whereby, the piston 278 is propelled in the direction of arrow 284. However, as the "flip" occurs in the system, pressure decreases within the expansion vessel 204 (see explanation regarding FIG. 2(*c*), above), and vacuum builds up therein, entailing displacing the piston 278 in direction of arrow 286, and so on, whereby a motor with a pulsating piston is obtained, useful in a variety of mechanical applications.

The purpose of the cooling system 280 is to increase the condensation rate of the vapor within the expansion vessel 204 for reducing vapor volume in order to ensure sufficient pressure drop therein, so as to facilitate displacement of the piston in the direction of arrow 286.

FIG. 3(*b*) is a simple example illustrating how the embodiment of FIG. 3(*a*) may be used for transferring linear reciprocal motion into cyclic output by pivotably connecting one end of a crank shaft 290 to the piston 278 and an opposed end to a fly wheel 292, as known per se.

Figure 4:
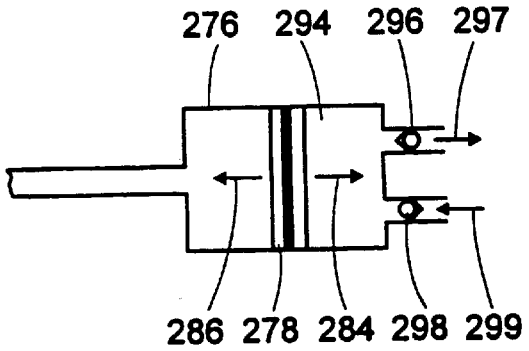
FIG. 4 is a partial view along line III–III in FIG. 3*a*, schematically illustrating another application of the present application useful as a fluid pump.

FIG. 4 illustrates how the embodiment of FIG. 3(*a*) may be used as a compressor or a pump, whereby a front chamber 294 of the cylinder 276 comprises a first check valve 296 allowing flow only in direction of arrow 297, and a second check valve 298 allowing flow only in direction of arrow 299. The arrangement is such that displacement of the piston 278 in the direction of arrow 286 brings about filling of the chamber 294 with a fluid, via check valve 298, where displacement of the piston in the direction of arrow 284 compresses the fluid via check valve 296.

Figure 5:
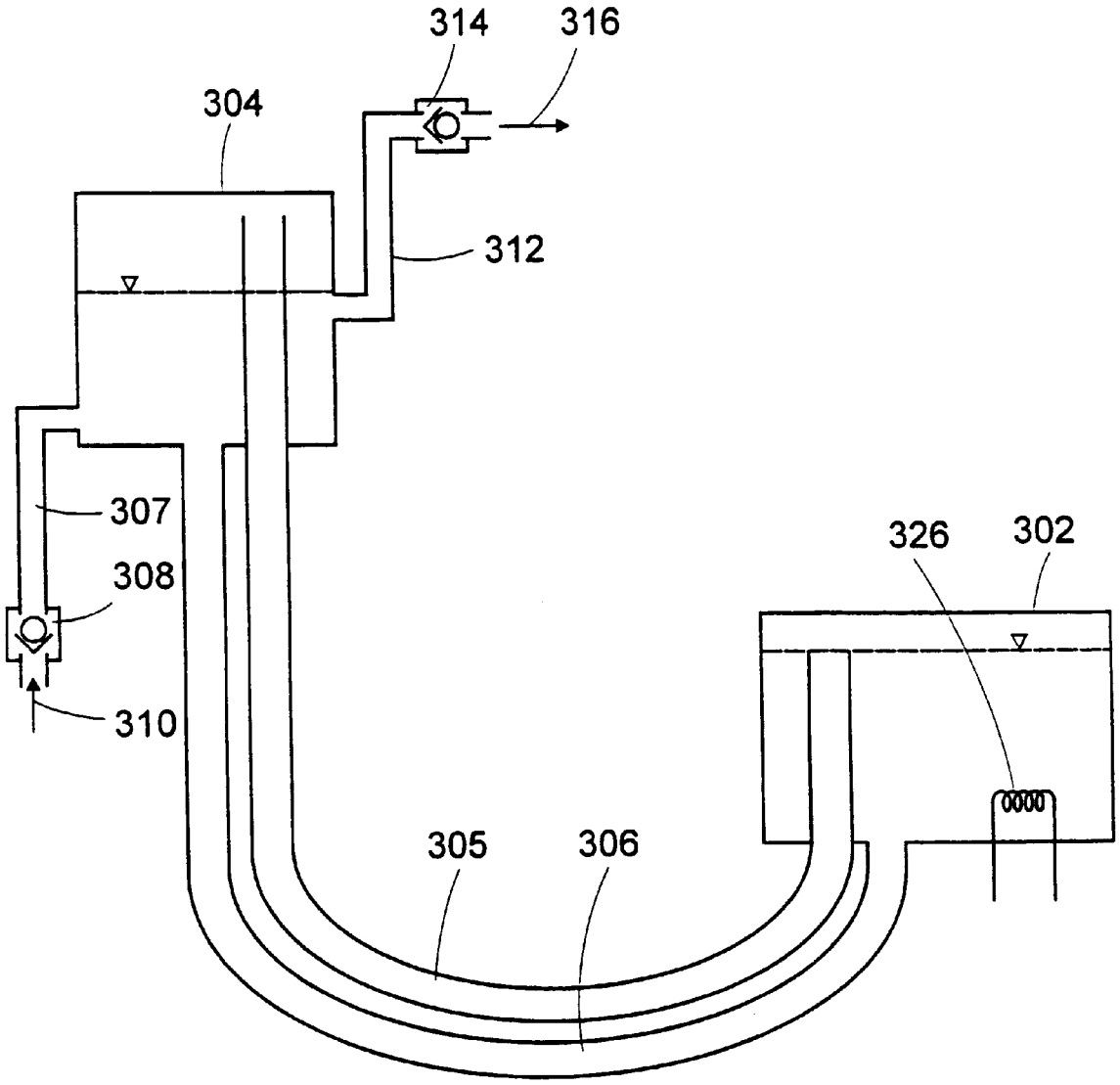
FIG. 5 is a schematic illustration of a pulsation liquid pump system according to the present invention.

FIG. 5 of the drawings illustrates a heat actuated pulsating liquid pump, the pumped liquid serving both as a driving and as a cooling media. The system consists of a basic cyclic fluid pulse generator system according to the present invention and as described, for example with reference to FIGS. 2(*a*) to 2(*d*) above. The system comprises a pressure vessel 302 with a heating element 326 and an expansion vessel 304 connected via a first tube 305 and a second tube 306 to the pressure vessel 302. The expansion vessel 304 further comprises an inlet pipe 307 provided with a first check valve 308 allowing flow only in the direction of arrow 310, and an outlet pipe 312 provided with a second check valve 314, allow flow only in the direction of arrow 316.

The system operates as explained with reference to FIGS. 2(*a*) to 2(*d*), whereby upon pressure increase within the expansion vessel (as a result of increasing the pressure in the pressure vessel 302), the liquid is expelled via pipe 312 and when the "flip" occurs, vacuum builds up in the expansion vessel 304 entailing suction of liquid via pipe 307 from a reservoir (not shown).

The vacuum in the expansion vessel 304 is caused owing to condensation of vapor in the expansion vessel, thus decreasing the volume of the vapor and building up vacuum. Since the pumped liquid constitutes the sole cooling media of the system, it is essential that its temperature is below that of the vapor's condensation temperature, at suction pressure.

By the arrangement of FIG. 5, the amount of liquid egressing via pipe 312 is equal to that ingressing via pipe 307. The outlet pressure of the liquid (emitted from pipe 312) mainly depends on the temperature of the liquid within the pressure vessel 302, whereas the output rate of the liquid via pipe 312, depends on the heat flow of the heating element 326.

Figure 6B:
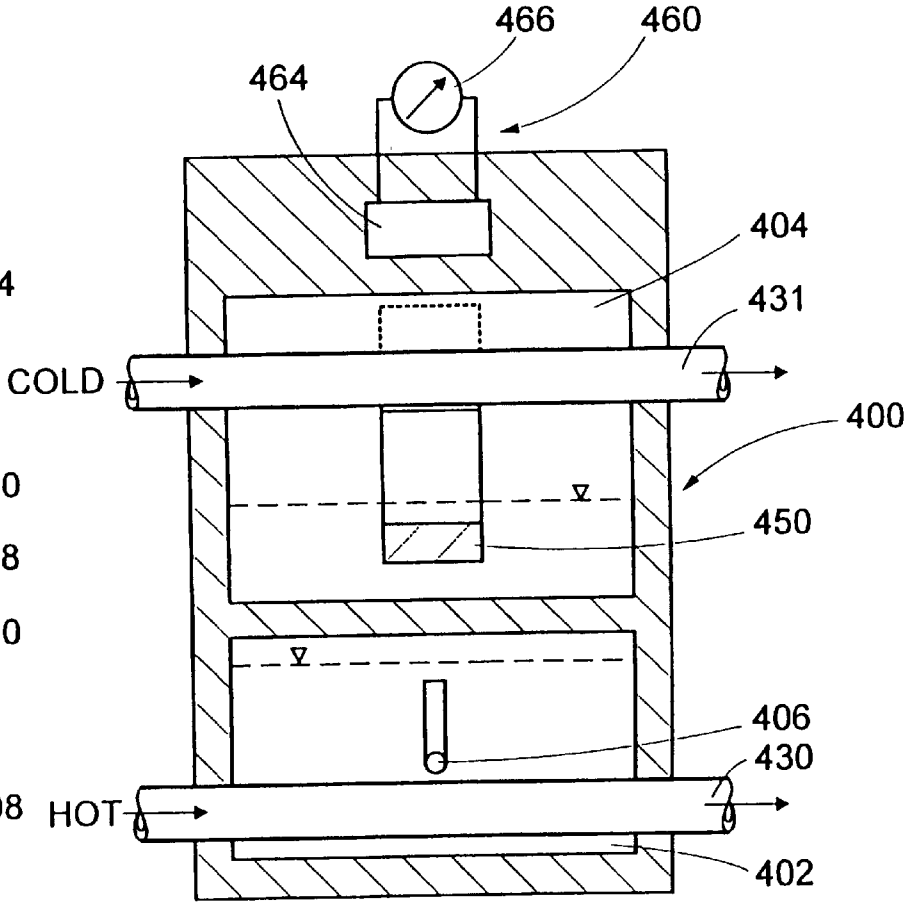
FIG. 6*b* is a cross-sectional view along line VI—VI in FIG. 6*a;*
Figure 6A:
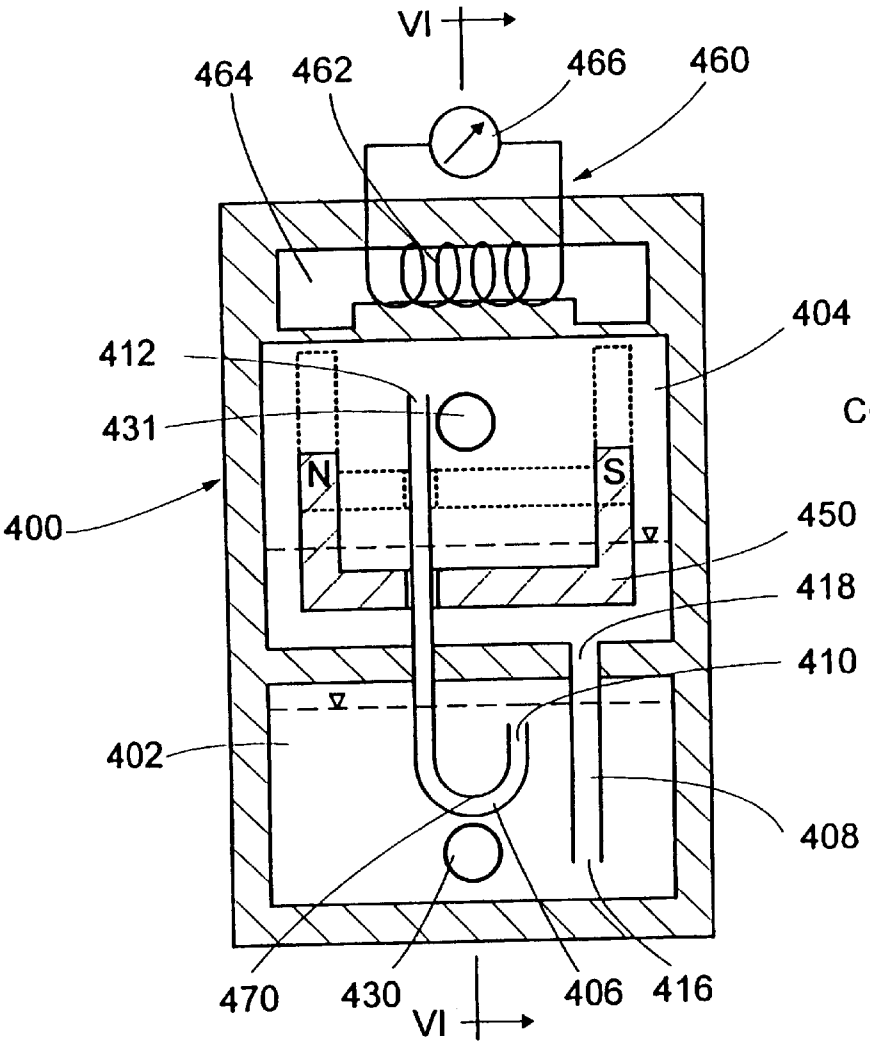
FIG. 6*a* is schematic illustrations of an energy meter according to an application of the present invention.
Figure 7A:
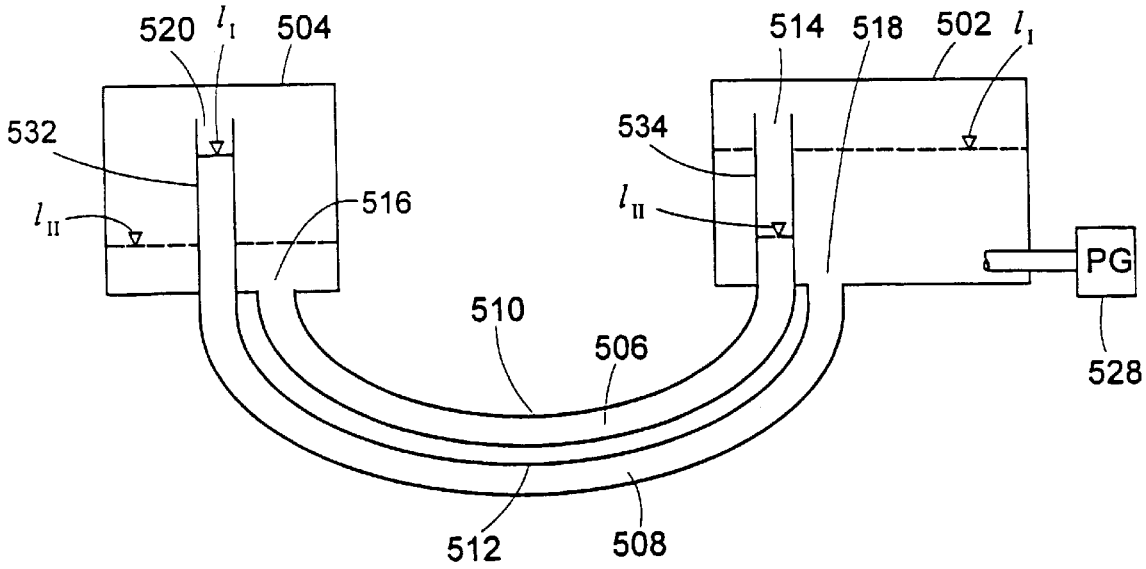
FIGS. 7*a*–7*d* illustrate an application of the present invention useful as a liquid flow rectifier, in four different operative stages.
Figure 7B:
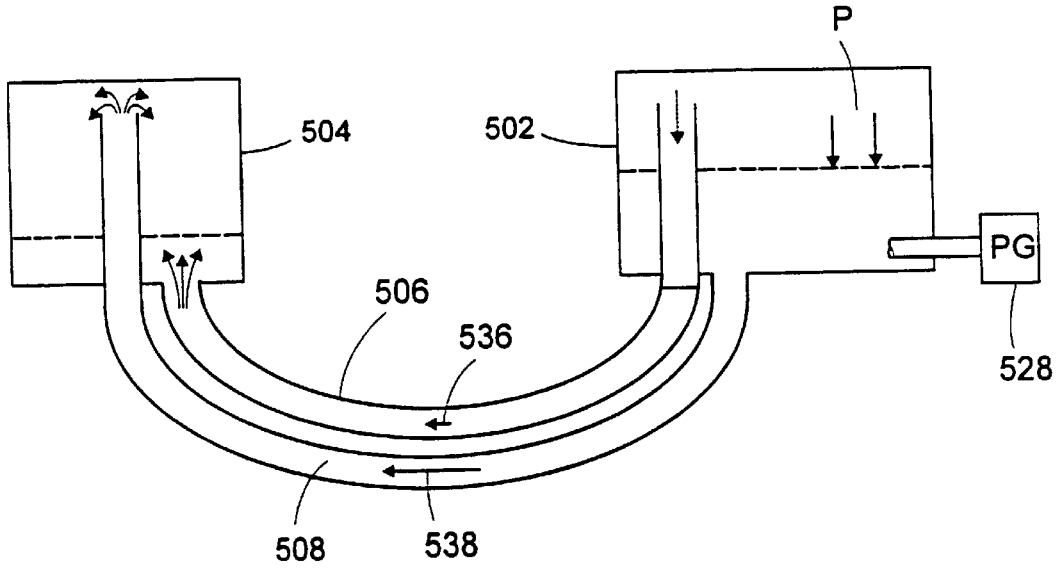
Figure 7C:
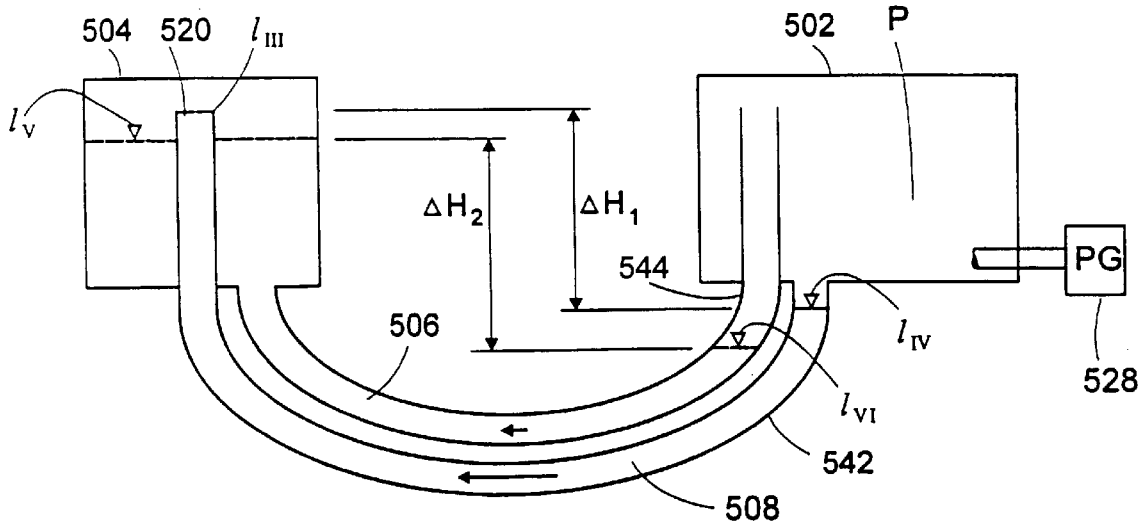
Figure 7D:
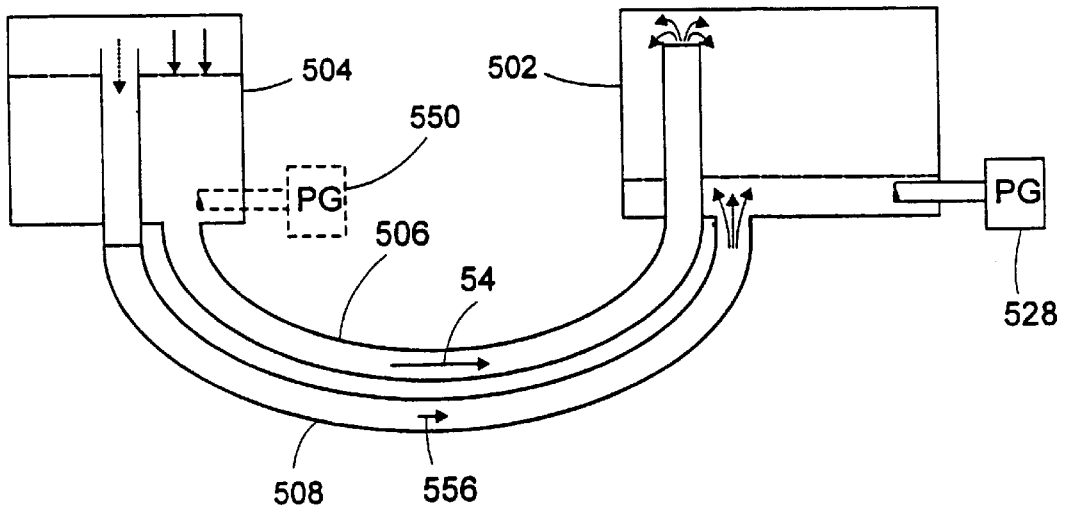

Attention is now directed to FIGS. 6(*a*) and 6(*b*) illustrating how the fluid displacement system of the invention may be used as an energy meter, for measuring heat consumption.

The meter consists of an insulated housing 400 comprising a thermally insulated pressure vessel 402 and an thermally insulated expansion vessel 404 above the pressure vessel. The vessels are in flow communication with one another via a first tube 406 and a second tube 408, the first tube having a U-like shape with a first opening 410 adjacent the top of the pressure vessel 402 and a second opening 412 adjacent the top of the expansion vessel 404 (see FIG. 6(*a*)). The second tube 408 is essentially vertical and has third and fourth openings 416 and 418 adjacent bottom portions of the pressure vessel and expansion vessel, respectively.

The energy meter further comprises a heat source 430 extending through the pressure vessel, which for example, may be a pipe supplying hot water to a consumer, whereby heat from the pipe is exchanged to the pressure vessel 402. A second pipe 431 extends through the expansion vessel 404 and carries cold water (for example water returning from the consumer), thus serving as a condenser.

A magnetic float member 450 is accommodated within the expansion vessel 404, being displaceable between a lowermost position (as illustrated by solid lines in FIG. 6(*a*)) and an upper position (as illustrated by dashed lines. A pick-up unit 460 consists of an electric inductive coil 462 coiled over a core member 464 and is connected to a meter 466 for registering and reading the number of occurrences in which the float member 450 reaches its uppermost position in which it inducts electric current in the coil 462.

The arrangement is such that at an initial stage, the pressure vessel 402 is filled with liquid to a level at least above the first opening 410. When hot water flows via tube 430, heat is transferred to the liquid until it reaches a boiling stage. Vapor displaces the liquid which then flows via the first and second tubes 406 and 408 to the expansion vessel sel 404, as a result of which the magnetic float member 450 reaches the top portion of the expansion vessel (illustrated by dashed lines) inducting an electric current in coil 462 which is then registered by the meter 466.

When the liquid level in the pressure vessel 402 drops below the top portion of bend 470 of the first tube 406, vapor enters the top, expansion vessel 404, as a result of which a "flip" occurs and the liquid returns to the pressure vessel via the second tube 408.

Since the heat transferred by the hot and cold tubes 430 and 431 respectively, is directly proportional to the temperature and quantity of fluid flowing via the tubes, the device measures the energy content difference between the ingressing and egressing fluid. It should be realized that such a system is useful in a variety of applications where it is required to measure heat consumption, e.g. for measuring the amount of hot water energy consumed by different consumers (domestic or industrial), etc. It should further be understood that instead of the electric inductance pick-up unit as described above, there may be used other means such as, for example, a mechanical counter or switch which is activated each time the float member reaches a predetermined level within the expansion vessel, or an electric circuit which is activated each time the float member closes a circuit between two conducting members positioned at the top portion of the expansion vessel, etc.

Attention is now directed to FIGS. 7(*a*) to 7(*d*) which illustrate a fluid flow rectifier which is devoid of mechanical components, i.e. check valves, pumps, etc.

Similar to the basic configuration of the cyclic fluid pulse generator disclosed with reference to FIGS. 1(*a*) to 1(*d*), the flow rectifier consists of a pressure vessel 502 connected to an expansion vessel 504 via a first tube 506 and a second tube 508, both having a U-like shape with a lowermost portion 510 and 512, respectively, thus behaving as syphon-tubes. The first tube 506 has a first opening 514 within the pressure vessel 502 and a second opening 516 within the expansion vessel 504. The second tube 508 has a third opening 518 within the pressure vessel and a fourth opening 520 within the expansion vessel.

The construction is such that the first opening 514 and the fourth opening 520 are adjacent top portions of the respective vessels, whereby the third opening 518 and the second opening 516 are adjacent bottom portions of the respective vessels.

The pressure vessel 502 further comprises a pressure generator 528 which as explained hereinabove may be a fluid heating element or a compressor, etc.

At an initial stage, as illustrated in FIG. 7(*a*), the pressure vessel 502 is filled with liquid up to level $l_{I}$, which owing to the rule of connected vessels, extends at the same level also within the vertical portion 532 of the second tube 508 (within the expansion vessel 504). Liquid level in the expansion vessel 504 is at level $l_{II}$, which again, owing to rule of connective vessels extend at the same level $l_{II}$ also within the vertical portion 534 of the first tube 506 within the pressure vessel 502. As can be seen, this arrangement actually constructs two systems of connected vessels being in flow communication with one another.

At a first stage of operation (see FIG. 7(*b*)), pressure is raised in the pressure vessel 502 by the pressure generator 528, whereby liquid flows from a pressure vessel 502 to the expansion vessel 504, in essentially small quantities via the first tube 506 (in the direction of arrow 536) and in essentially large quantities via the second tube 508 (in the direction of arrow 538), for the reasons hereinabove explained.

As seen in FIG. 7(*c*), the liquid continues to flow from the pressure vessel 502 to the expansion vessel 504 via both tubes 506 and 508 until equilibrium is obtained wherein the height difference $\Delta H_1$ (between the level $l_{III}$ of the fourth opening 520 and liquid level $l_{IV}$ at the vertical portion 542 of the second tube 508 adjacent the present vessel 502) is identical with the height difference $\Delta H_2$ between the liquid level $l_V$ at the expansion vessel 504 and the liquid level $l_{VI}$ at the vertical portion 544 of the first tube 506 adjacent the pressure vessel 502. That is $\Delta H_1 \equiv \Delta H_2$, where an outcome of this relation is that $(l_{III}-l_V) \equiv (l_{IV}-l_{VI})$. Care should be taken to assure that the liquid level $l_V$ is lower than $l_{III}$, for ensuring that the liquid will under no circumstances flow in reverse direction, i.e. from the expansion vessel 504 to the pressure vessel 502, unless the pressure generator applies negative pressure (i.e. vacuum) or in case a second pressure generator 550 connected to the expansion vessel 504 is activated (shown in dashed lines in FIG. 7*d*), whereby the vessel and tube exchange tasks and liquid will flow only from the expansion vessel 504 to the pressure vessel 502, in large quantities in the first tube 506 (in the direction of arrow 554) and in small quantities in the second tube 508 (in the direction of arrow 556), whereby a flow rectifier is obtained.

Figure 8:
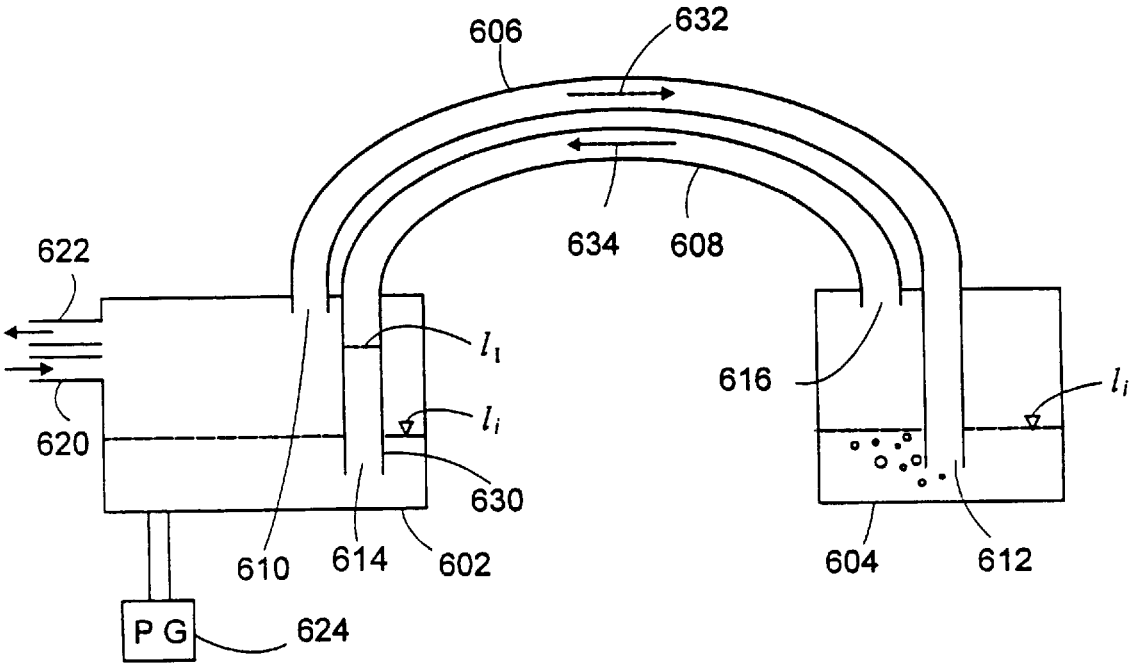
FIG. 8 is a schematic illustration of a gas flow rectifier in accordance with an application of the present invention.

FIG. 8 of the drawings illustrates how the system according to the present invention may be used as a gas flow rectifier, devoid of any mechanical components (such as check valves, pumps, etc.). The system comprises a pressure vessel 602 and an expansion vessel 604 connected to one another by a first tube 606 and a second tube 608, both having an inverted U-like shape and behaving as syphon tubes.

The first tube 606 has a first opening 610 within the pressure vessel and a second opening 612 within the expansion vessel 604 and the second tube 608 has a third opening 614 within the pressure vessel and a fourth opening 616 within the expansion vessel, the first and fourth openings 610 and 616 being at top portions of the respective vessels, and the second and third openings 612 and 614 being adjacent the bottom of the respective vessels.

The pressure vessel 602 further comprises a gas ingress pipe 620, a gas egress pipe 622 and a pressure generator 624 as hereinabove explained. As can further be seen in FIG. 8, at an initial stage the vessels are filled with liquid at a level li, over the second and third openings 612 and 614 respectively, but below the first and fourth openings 610 and 616 respectively.

The arrangement is such that upon introducing gas into the pressure vessel 602 via pipe 620 and increasing pressure by the pressure generator 624 (e.g. by heating), liquid level in the pressure vessel will slightly decrease, entailing a rise of a fluid column in the vertical portion 630 of the second tube 608 to level l1, serving as a block, whereby gas will be forced to flow through the first opening 610, via the first tube 606 to the expansion vessel 604 (in the direction of arrow 632), exiting at the expansion vessel via the second opening 612 and then, via the fourth opening 616 flows through the second tube 608 back to the pressure vessel 602 (in the direction of arrow 634), and out of the system via pipe 622.

It should be realized that gas cannot flow in reverse directions, unless pressure is raised in the expansion vessel 604, whereby the vessels and tubes exchange roles.

Figure 9:
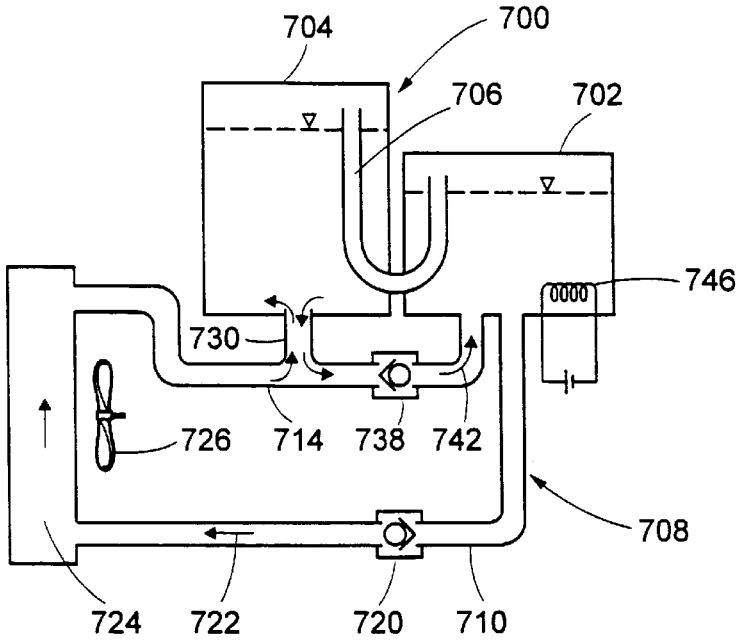
FIG. 9 is a schematic illustration of an application of the present invention useful as a low pressure, rectified fluid circulating pump.

Further reference is made to FIG. 9 illustrating a low pressure liquid circulating pump consisting of a liquid displacing system generally designated 700 and constructed of a pressure vessel 702, an expansion vessel 704, a first tube 706 connecting between the vessels and having a U-like shape, and a second tube generally designated 708 and consisting of a first and a second tube portion 710 and 714, respectively. The first tube portion 710 extends from a bottom portion of the pressure vessel 702 and connected via a first check valve 720 , allowing flow only in direction of arrow 722, to a cooling unit 724 such as radiator with a fan 726, as known per se. The second tube portion 714 extends from the cooling unit 724 via a connecting tube 730 into a bottom portion of the expansion vessel 704 and back into the pressure vessel 702 via a second check valve 738, allowing flow only in the direction of arrow 742. A heat source 746 is provided within the pressure vessel 702 as explained in connection with the previous applications.

The arrangement is such that pressure increase by vaporization within the pressure vessel 702 entails liquid flow to the expansion vessel 704 via the first tube 706 and via tube 710, in direction of arrow 722. Then, the liquid passes through the cooling unit 724 and continues via tube 714 into the expansion vessel 704. The cooled liquid entering the expansion vessel causes condensation of vapor accumulating within the expansion vessel, at the time the "flip" occurs, and thus reduces the pressure of the system to the initial pressure of the system.

The above described construction ensures that liquid always flows in direction of arrows 722 and 742, whereby a liquid pump is obtained.

The pressure head of the pump is set by pressure vessel and expansion vessel temperatures of the liquid and maximum head of the liquid within the tube 706.

It should, however be obvious that one or both of the check valves 720 and 738 may be replaced by a flow rectifier of the type described, for example, with reference to FIGS. 7*a*–7*d*.

Figure 10:
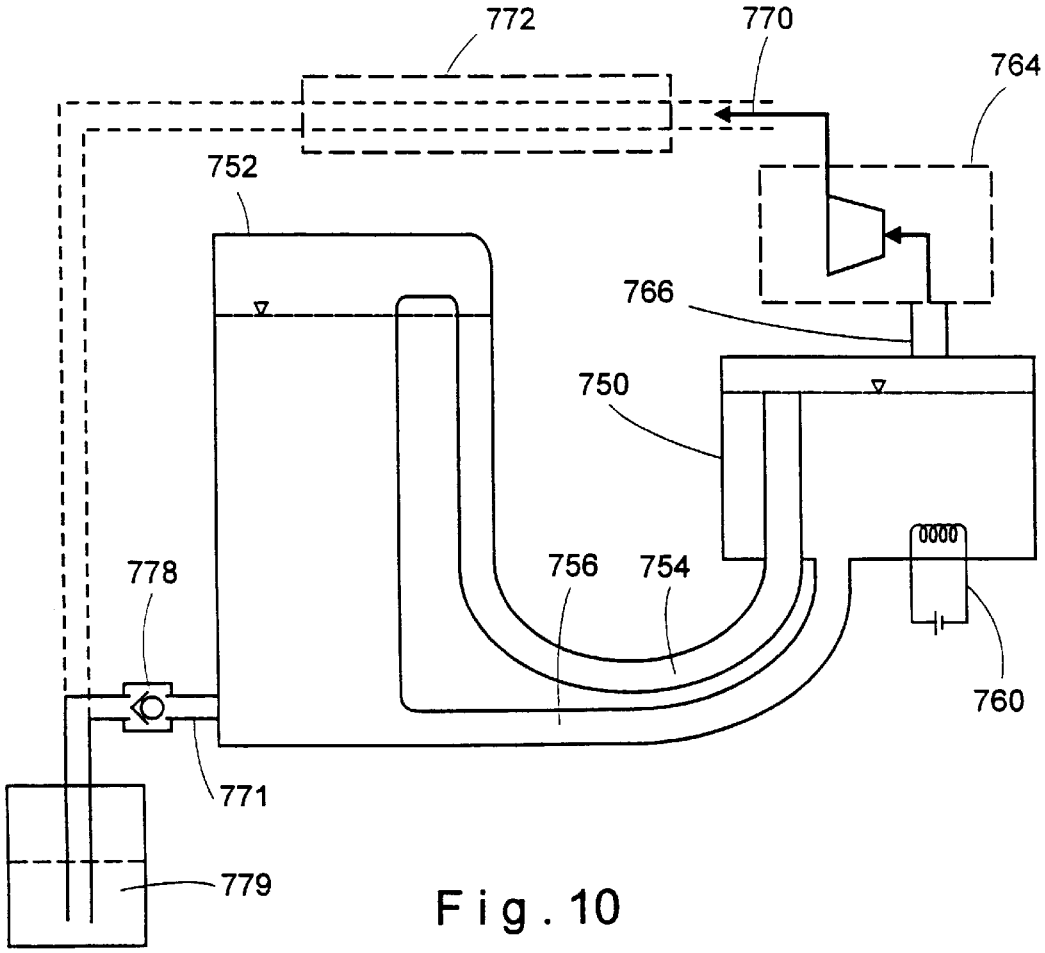
FIG. 10 is a schematic presentation of a further application of the present invention useful as a self pumping boiler.

The application schematically illustrated in FIG. 10 of the drawings illustrated a self pumping boiler applicable, for example, in steam operated systems. The system consists of a pressure vessel 750 connected to an expansion vessel 752 via a first tube 754, having an essentially U-like shape, and a second tube 756, extending from bottom portions of the vessels. The pressure vessel 750 is also provided with a heating element 760, as explained in connection with the previous embodiments.

A steam operated restriction member such as an engine or a restriction valve, generally designated 764, is connected via tube 766 at a top portion of the expansion vessel 750. By one application, illustrated in FIG. 10 by solid lines, the expansion vessel 752 is connected via a tube 771 and through a check valve 778 to a cold liquid source 779. By a second application, illustrated in FIG. 10 by dashed lines, the restriction member 764 is connected via a return tube 770 to a condenser 772 for converting the return vapor into liquid, which liquid is returned to the expansion vessel 752 via check valve 778. During the "flip" occurrence, cool liquid flows via check valve 778 back into the expansion vessel 752.

The above described system provides a self priming boiler which is suitable for connecting to a steam consuming device (engine, vapor heated container, etc.), whereby the thermal efficiency of the pumping system is ultimate since the steam used for inducing the "flip" is fully utilized for pre-heating the cool liquid feed.

Figure 11A:
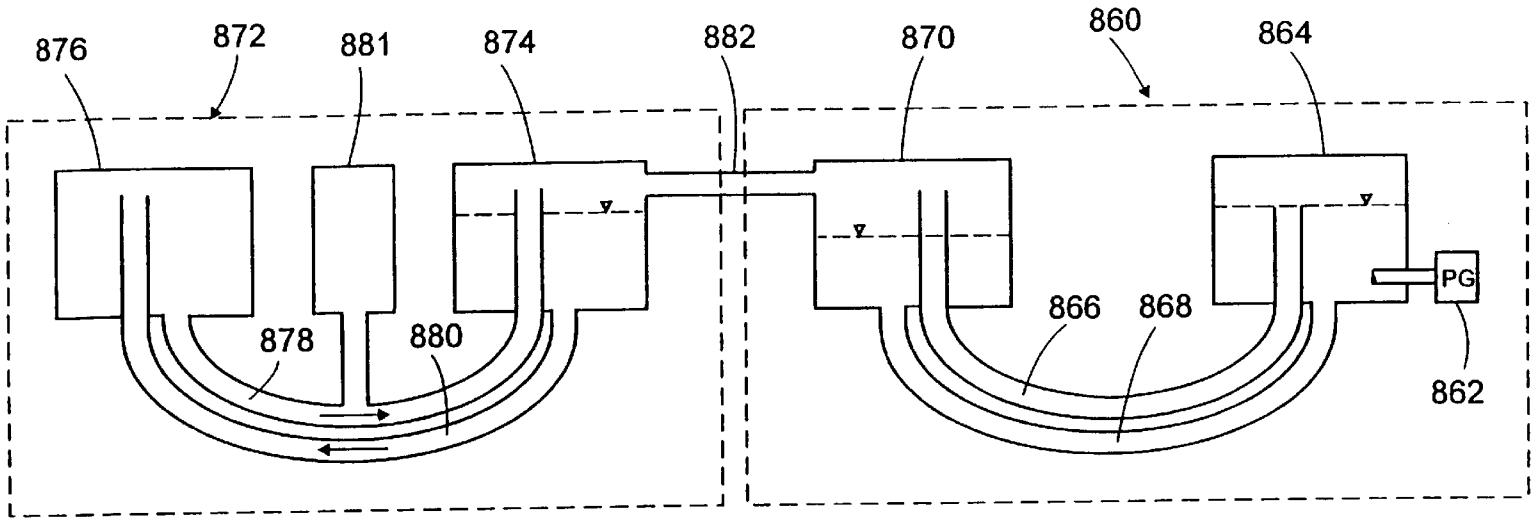
FIG. 11*a* is a schematic illustration of a first embodiment of a valveless liquid circulating pump.
Figure 11B:
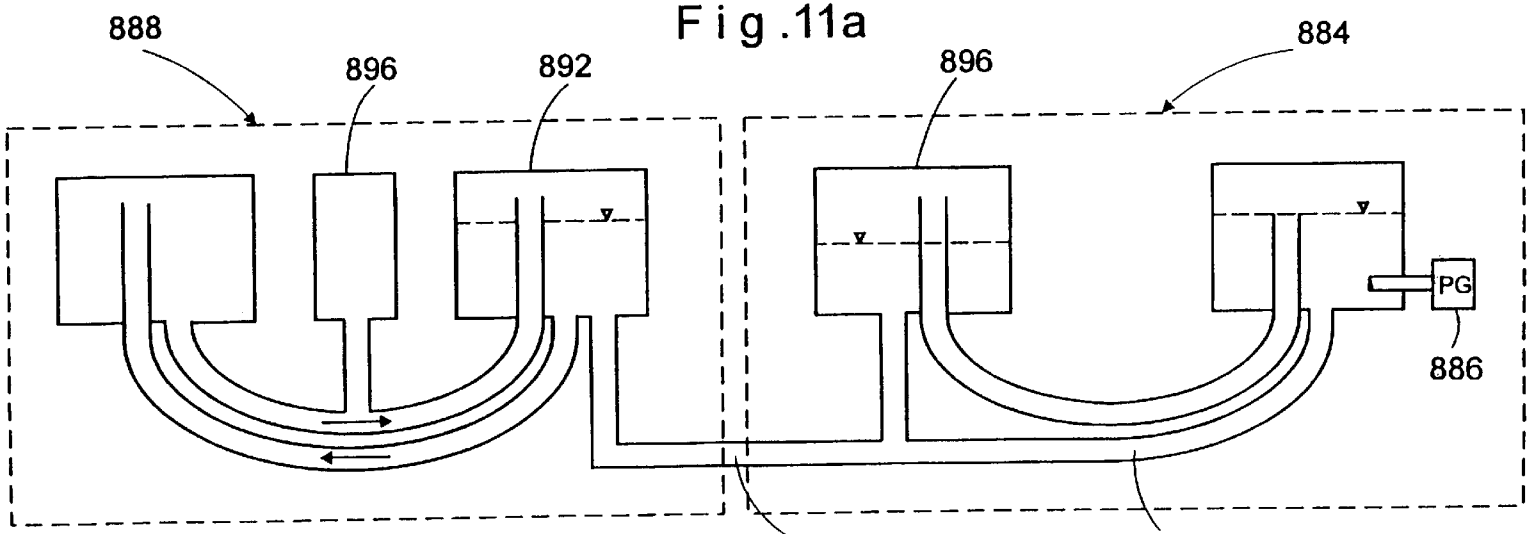
FIG. 11*b* is a schematic illustration of a second embodiment of a valveless liquid circulating pump in accordance with the present invention.

Attention is now directed to FIGS. 11(*a*) and 11(*b*) illustrating two variations of a liquid pump with an integral flow rectifier, wherein the flow rectifier does not comprise an independent pressure source but is rather activated by the liquid displacing system.

Referring first to FIG. 11(*a*), there is a liquid displacing system generally designated 860 and having a configuration similar to that described with reference to FIGS. 1(*a*) to 1(*d*) with a pressure source 862 connected to the pressure vessel 864 which in turn is connected via a first tube 866 and a second tube 868 to an expansion vessel 870.

A flow rectifier unit generally designated 872 has a configuration similar to that described above with respect to FIGS. 7(*a*) and 7(*d*), and comprises a pressure vessel 874, an expansion vessel 876 and first and second tubes connecting therebetween, 878 and 880 respectively. Preferably, an accumulator 881 is connected to the flow rectifier unit 872, for reducing the overall dimensions of the pressure and expansion vessels.

However, instead of an independent pressure source (such as pressure generator 528 in FIG. 7(*a*)), the pressure vessel 874 of the rectifier unit 872 is connected to the expansion vessel 870 of the liquid displacing system 860 via a pipe 882 extending at top portions of the vessels, whereby the rectifier is initialized by pressure received from the liquid displacing system, and a uni-directional liquid circulating pump is obtained.

Similar to the arrangement illustrated in FIG. 11*a*, the arrangement of FIG. 11(*b*) also comprises a liquid displacing system generally designated 884 comprising the same principal components as in FIG. 11(*a*), including a pressure source 886.

The system further comprises a flow rectifier generally designated 888 which also comprises the same principal components as in FIG. 11(*a*) described above). However, in this case too, the flow rectifier 888 is devoid of a separate pressure source and is rather connected via a tube 890 extending from a bottom portion of the pressure vessel 892 of the flow rectifier 888 to a lowermost portion of the second tube 894 of the liquid displacing system 884. However, according to this configuration, the flow rectifying unit 888 should preferably comprise an accumulator 896 for reducing the size of the system's vessels.

In this case too, the flow rectifier is initialized by the pressure received from the liquid displacing system and a uni-directional liquid pump is obtained.

Figure 12:
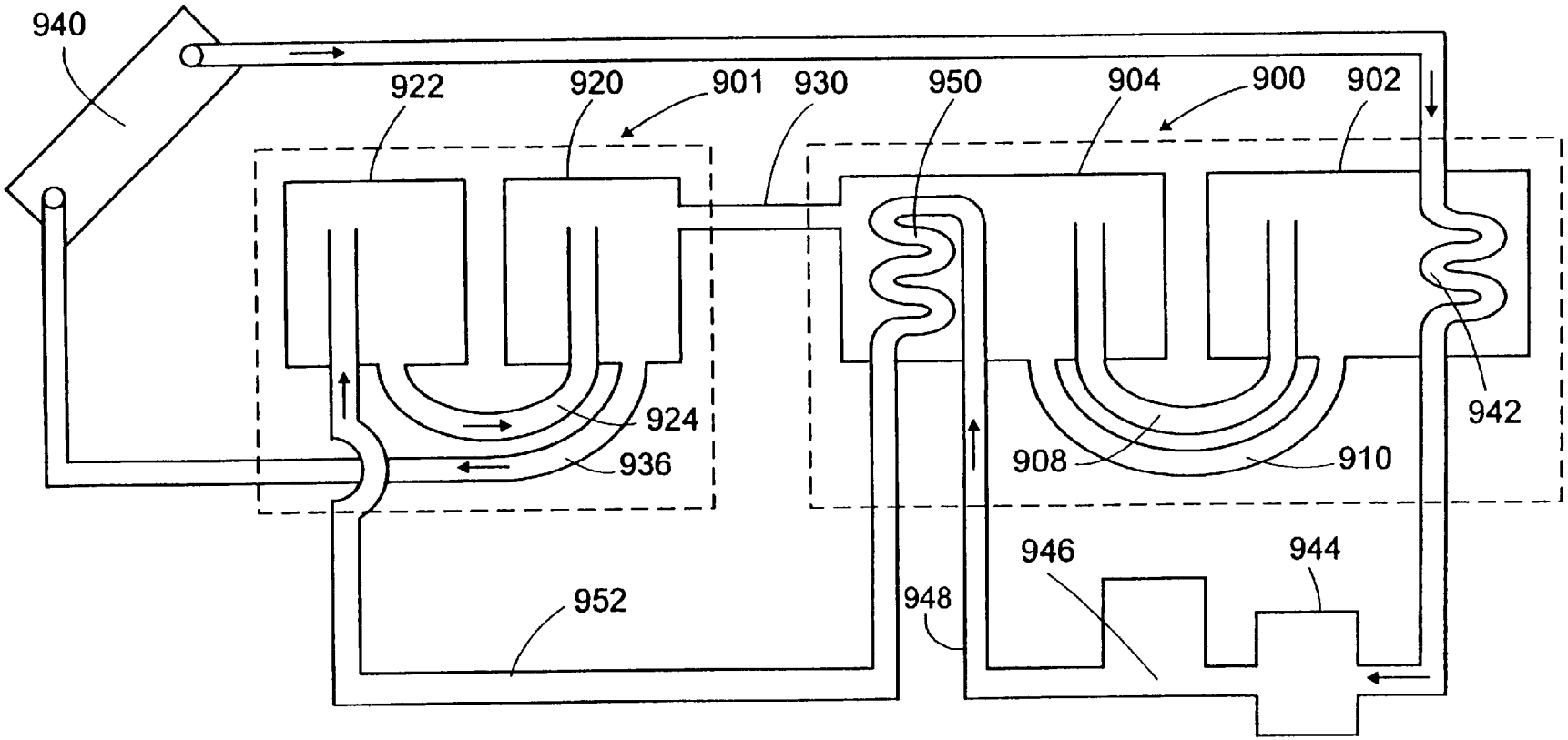
FIG. 12 is a schematic illustration of a self circulating system using two liquids having different boiling temperatures, in accordance with an application of the invention.

FIG. 12 is a schematic illustration of still another practical application of the system according to the invention useful for circulating a liquid in a heating or cooling system, having a low temperature difference between ingressing and egressing liquid, for example, in a domestic solar heating system, whereby a thermo-syphon system is obviated, thus hot water may be circulated also downward without the need of mechanical pumps, etc. (In conventional solar heating systems the solar panels must always be below the hot water reservoir, otherwise, pumps are required). The problem with existing non-thermo-syphon systems is that they rely on propelling the water by steam bubbles which are formed within the system when the water reaches its boiling point. However, it is obvious that standard flat-panel solar collectors are unable to reach temperatures exceeding about 60–80° C. (depending on geographic location, period of the year and time of the day).

The system illustrated in FIG. 12 consists of a liquid displacement system generally designated 900 being operable with a first liquid having a low boiling temperature point, and a flow rectifying unit generally designated 901 being operable with a second liquid having an essentially high boiling temperature point, such as water. The liquid displacing system 900 comprises a pressure vessel 902 connected to an expansion vessel 904 via a first, syphon-like tube 908 and a second tube 910 extending between bottom portions of the vessels. The flow rectifying unit 901 comprises a pressure vessel 920 and an expansion vessel 922 connected to one another by a first tube 924. The second tube of the flow rectifying unit extends via the solar panel and heat exchanging system of the device, as explained hereinafter.

As explained with reference to FIG. 11*a*, the expansion vessel 920 of the flow rectifying unit 901 is connected to the expansion vessel 904 of the liquid displacement system 900 by a tube 930, whereby the rectifier will be initialized by pressure received from the liquid displacing system, and a uni-directional liquid circulating pump is obtained as already explained with respect to FIG. 11(*a*).

The second tube of the flow rectifying unit 901 is constituted by a tube portion 936 extending from a bottom portion of the pressure vessel 920 which is connected to a solar panel 940. The solar panel is connected in turn to a first heat exchanging portion 942 extending within the pressure vessel 902 of the liquid displacing system 900 and then continues to a container 944 with an associated accumulator 946. A tube 948 extends from the accumulator to a second heat exchanging portion 950 within the expansion vessel 904 of the liquid displacing system and a return tube 952 is connected to the expansion vessel 922 of the flow rectifying unit 901, whereby the loop of the second tube of the rectifying unit is completed.

The arrangement is such that liquid heated in the solar panel 940 flows to the heat exchanging portion 942 within the pressure vessel 902 of the liquid displacement system, thus constituting a heat source for raising pressure within the pressure vessel. Then, the liquid flows via the container and accumulator 944 and 946, respectively, expelling the cold liquid therefrom. The expelled cool liquid then passes through the second heat exchanging portion 950 within the expansion vessel 904 condensing the vapor of the second liquid, as explained hereinabove with respect to previous embodiments. The liquid then returns via tube 952 to the expansion vessel 922 of the rectifying unit 901, flows via the first tube 924 into the expansion vessel 920 and then via tube 936 closes the loop where it enters the solar panel 940 for re-heating and beginning a new cycle.

However, it should be obvious that the liquid is displaced within the system by the liquid displacing system 900 with the rectifying unit 901 ensuring liquid flow in the desired direction only, with the displacement system constituting the initiating source of the rectifying unit (as explained with respect to FIG. 11(*a*)). The entire system is energized by the solar heat collected by the solar panel 940 and transferred to the pressure vessel 902.

The system described hereinabove with reference to FIG. 12 is devoid of membranes which are typically required in existing systems for separating between the first, so-called propelling liquid, and the second, so-called propelled liquid. Furthermore, it is not necessary to bring the propelled liquid to its boiling point, whereby a larger variety of liquids may be used.

It should be obvious to a person versed in the art that the system above described may be utilized in a variety of other applications such as, for example, industrial or domestic heating or cooling systems and various elements may be replaced e.g. the solar panel may be replaced by a boiler and the container may be replaced by a heating radiator. It should also be noted that the liquid flow rectifying unit may be replaced by suitable check valved with the required changes mutatis mutandis.

Figure 13:
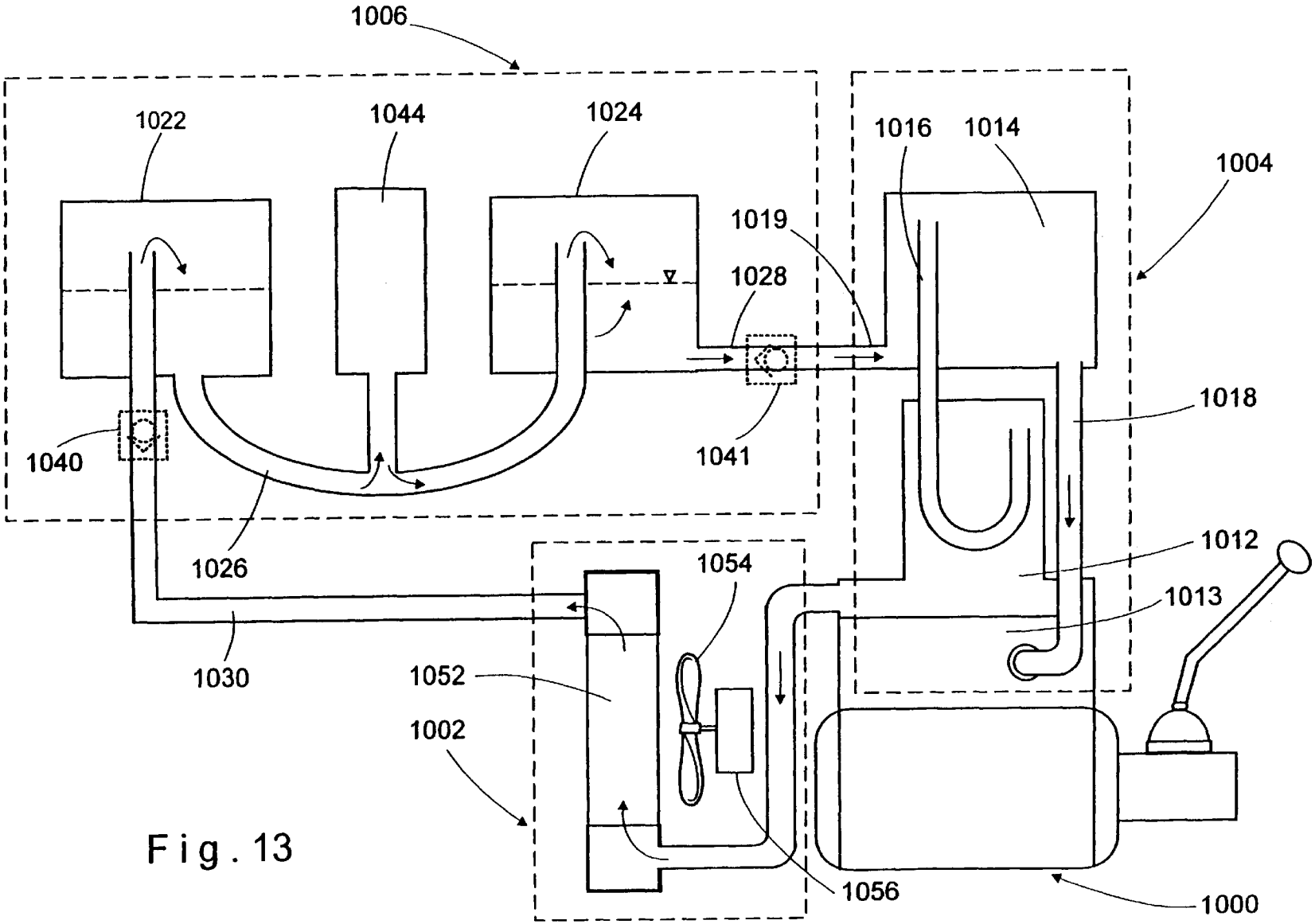
FIG. 13 is a schematic illustration of a system according to the present invention useful for circulating a coolant liquid in an engine, the system being devoid of mechanical components.

FIG. 13 schematically illustrates how the invention may be utilized in a cooling system for a motor, e.g. in a vehicle's engine.

The system consists of four principal components, namely, an engine generally designated 1000 which is actually a heat source requiring cooling, a liquid cooling unit generally designated 1002 such as a vehicle's radiator and fan as known per se, a liquid displacing system generally designated 1004 for cycling the coolant liquid, and a flow rectifying unit designated 1006 serving as a check valve for controlling flow direction. All the components are in flow communication for conjoined operation as will hereinafter be explained.

The liquid displacing system 1004 consists of a pressure vessel 1012 mounted on the engine's block 1013 for receiving heat, and an expansion vessel 1014 connected to the pressure vessel via a first U-like tube 1016 and a second, vertical tube 1018. The expansion vessel 1014 is provided also with an inlet pipe 1019.

The liquid flow rectifying system 1006 is principally similar to that described in connection with FIGS. 7(*a*) to 7(*d*) having a pressure vessel 1022 and an expansion vessel 1024 connected to one another via a first tube 1026 and a second tube which in the present embodiment exits the expansion vessel by tube portion 1028, passes through the liquid displacing system 1004, the engine 1000 and the cooling unit 1002 and returns back to the pressure vessel 1022 by pipe 1030. As can readily be understood, the purpose of the flow rectifier 1006 is to ensure coolant liquid flow only in the direction of the arrows appearing in the diagram. Also, the flow rectifier described above may be replaced by suitable check valves as schematically illustrated by dashed lines and designated 1040 and 1041.

The system further comprises an accumulator 1044 mounted in flow communication with tube 1026, which accumulator is required for transferring essentially large quantities of coolant liquid. However, the accumulator 1044 which does not constitute a part of the flow rectifier 1006 may be omitted provided that the pressure and expansion vessels 1022, 1012, 1024 and 1014, respectively, are sufficiently large for receiving large liquid volumes.

The cooling system 1002 consists of a radiator 1052 comprising a plurality of fins (not shown) and a fan 1054 activated by an electric motor 1056 for exciting air through the radiator 1052 for exchanging heat with the hot liquid as known per se. As an option, the electric motor 1056 driving the fan 1054 may be replaced by a liquid displacing system having a mechanical output, e.g. of the type described in FIGS. 3(*a*) and 3(*b*).

In operation, only when the engine reaches a minimal predetermined temperature and the coolant liquid reaches its boiling temperature, the liquid displacing system 1004 will be activated as explained hereinabove with respect to some of the previous embodiments, whereby liquid begins to flow from the engine 1000 via the cooling system 1002, where its temperature is reduced, and then via the flow rectifier 1006 and via the liquid displacing system 1004, to complete a cycle.

Obviously, various components may be positioned at different locations, and may also be replaced by mechanical components as known per se.

It should be understood by a skilled person that a large combination of different embodiments may be made for various applications, mutatis mutandis.

I claim:

1. A fluid displacement system comprising a pressure vessel, an expansion vessel, first and second tubes being each in flow communication with the two vessels, fluid contained within the system, and an energy source for generating pressure in said pressure vessel; said first tube having a first opening within said pressure vessel, a second opening within said expansion vessel, and tube sections extending between said first and said second openings connected to one another by a first intermediate section; said second tube having a third opening at a bottom portion of said pressure vessel and a fourth opening within said expansion vessel; said first opening being above said third opening; wherein at a rest stage of the system, prior to activating the energy source, the fluid level within the vessels exceed at least one of the first and second opening and at least one of the third and fourth opening.

2. A system according to claim 1, wherein the tube sections of the first tube extend downwards from the first and second openings and said first intermediate section is a lowermost section.

3. A combination system according to claim 2, wherein the fluid displacement system is a first fluid displacement system the combination system further comprising second and third fluid displacement systems, with the first fluid displacement system having a second intermediate section extend between said third and said fourth openings and the second intermediate section being below said first intermediate section so that said first fluid displacement system is a cyclic fluid pulse generator and a liquid pump, and the second and third fluid displacement systems have said second opening at a bottom of said expansion vessel and said fourth opening positioned above said second opening, wherein the second tube of the cyclic fluid pulse generator extends from a bottom portion of the pressure vessel and is connected via said second fluid displacement system, which serves as a first liquid flow rectifier, to a cooling device, which cooling device is connected in turn to a bottom portion of the expansion vessel of said cyclic fluid pulse generator and via said third fluid displacement system, which serves as a second liquid flow rectifier, to said pressure vessel of said cyclic fluid pulse generator.

4. A combination system according to claim 2, wherein said fluid displacement system is a first fluid displacement system, the combination system further comprising a second fluid displacement system, with the first fluid displacement system having a second intermediate section extending between said third and said fourth openings and the second intermediate section being below said first intermediate section so that said first displacement system forms a cyclic fluid pulse generator and a liquid pump, and the second fluid displacement system having said second opening at a bottom of said expansion vessel and said fourth opening positioned above said second opening so that said second displacement system forms a liquid flow rectifier.

5. A combination fluid displacement system according to claim 4, wherein the expansion vessel of the cyclic fluid pulse generator is in flow communication with the pressure vessel of the flow rectifier, allowing gas transfer only.

6. A combination fluid displacement system according to claim 4, wherein the second tube of the cyclic fluid pulse generator is in flow communication with a bottom portion of the pressure vessel of the flow rectifier.

7. A combination fluid displacement system according to claim 4, wherein the flow rectifier comprises an expansion chamber that forms an accumulator.

8. A system according to claim 2, wherein a second intermediate section extends between said third and said fourth openings, said second intermediate section being below said first intermediate section so that said system operates as a cyclic fluid pulse generator.

9. A system according to claim 8, wherein during a working stage of the system the fluid level in the expansion vessel is higher than fluid level in the pressure vessel; the difference in height being such that once liquid is cleared from said first tube to an extent to allow gas communication between the two vessels through the first tube, there is a pressure head sufficient to overcome flow losses in said second tube to allow flow of liquid therethrough up to a level equal to or above said first opening.

10. A system according to claim 8, said cyclic fluid pulse generator being a liquid pump, wherein the second tube of the system extends from a bottom portion of the pressure vessel and is connected via a first flow rectifying unit to a cooling device, which cooling device is connected in turn to a bottom portion of the expansion vessel and via a second flow rectifying unit to the pressure vessel.

11. A system according to claim 8, wherein the cyclic fluid pulse generator operates as a liquid pump and said system is provided with a flow rectifying arrangement provided between said expansion vessel and said pressure vessel.

12. A liquid pump according to claim 11, wherein the flow rectifying arrangement consists of two check valves positioned in series with one another along a tube connected to the bottom portion of said pressure vessel.

13. A liquid pump according to claim 11, said liquid pump circulating a liquid between a liquid heating device and a liquid container.

14. A liquid pump according to claim 11, said liquid pump circulating a liquid in a heating system wherein the energy source is heat applied to the pressure vessel.

15. A liquid pump according to claim 11, said liquid pump circulating a cooling liquid agent of an engine, wherein heat emitted from the engine is used as the energy source.

16. A system according to claim 8, said system being operable as a self priming boiler wherein steam is provided to a steam operated system from the pressure vessel of the fluid pulse generator, there being provided a cold liquid source connected to the expansion vessel via a check valve allowing flow into the expansion vessel only.

17. A self priming boiler according to claim 16, wherein steam flows from the steam operated system, via a condenser into the cold liquid source.

18. A system according to claim 1, wherein said energy source is a heat source arranged so as to heat the fluid within said pressure vessel.

19. A system according to claim 1, wherein said energy source is a pressure source.

20. A system according to claim 1, wherein said fluid is a liquid.

21. A system according to claim 1, wherein the expansion vessel is sealed and comprises a fluid outlet connected to a cylinder with a piston reciprocally retained therein.

22. A system according to claim 21, wherein the piston is linked to a crank shaft for converting linear reciprocating motion of the piston into circular motion.

23. A system according to claim 21, wherein said expansion vessel further comprises a pressure reducing system for improving condensation of a vapor retained therein.

24. A system according to claim 23, wherein the expansion vessel further comprises a non-condensable gas.

25. A system according to claim 23, wherein the cooling system is a condenser.

26. A system according to claim 21, wherein the system operates as a compressor or a pump, wherein the piston sealingly divides the cylinder into a first and a second portion, said first portion being in flow communication with the expansion vessel and said second portion comprises a first check valve for fluid inlet and a second check valve for pressurized fluid outlet.

27. A system according to claims 2, wherein the energy source is a heat source extending through the pressure vessel, and the system further includes a cold source extending through the expansion vessel and a counting unit activated by an activator displaceable upon change in fluid level within the vessels, whereby the system acts as an energy meter to measure the heat exchange between the heat source and the cold source.

28. An energy meter according to claim 27, wherein the counting unit is associated with the expansion vessel and the activator is displaceable within the expansion vessel.

29. A system according to claim 27, wherein the actuator is a float member having a conductive portion for closing an electric circuit of the counting unit.

30. A system according to claim 27, wherein the actuator is a float member having an inductive portion for magnetically activating the counting unit.

31. A system according to claim 27, wherein the actuator is a float member adapted for mechanically activating said counting unit.

32. A system according to claim 1, wherein the vessels and the tubes are inverted whereby the first and second tubes each comprise tube sections extending upwardly from the first, second, third and fourth openings respectively, the respective tube sections being connected by uppermost intermediate sections; wherein at the rest stage of the system, the fluid level within the vessels exceeds the second and the third opening.

33. A system according to claim 32, wherein the system forms a gas flow rectifier.

34. A liquid displacing system according to claim 1, comprising a cyclic fluid pulse generator operable with a first liquid having a low boiling temperature; and a flow rectifier operable with a second liquid having a high boiling temperature; the fluid pulse generator being in flow communication with the flow rectifier via a first pipe connecting the expansion vessel of the fluid pulse generator with the pressure vessel of the flow rectifier; and a second tube extending from a bottom portion at the pressure vessel of the flow rectifier into a heating unit, via a first heat exchanger within the pressure vessel of the fluid pulse generator, than via a second heat exchanger within the expansion vessel of the fluid pulse generator and returning into the expansion vessel of the flow rectifier, at a top portion thereof.

35. A liquid displacing system according to claim 34, wherein an accumulator is provided on the second tube.

36. A system according to claim 2, being a liquid flow rectifier, wherein said second opening is at the bottom of the expansion vessel and said fourth opening is positioned above said second opening.

37. A system according to claim 36, wherein the fourth opening is essentially at the same level as the first opening.

38. A fluid displacement system for displacing a fluid contained in the system, comprising:

a pressure vessel;

an expansion vessel;

a first tube connecting the pressure vessel and the expansion vessel, and having a first opening within the pressure vessel, a second opening within the expansion vessel and tube sections extending between the first and second openings connected to one another by a first intermediate section;

a second tube connecting the pressure vessel and the expansion vessel, and having a third opening at a bottom portion of the pressure vessel and a fourth opening within the expansion vessel, the first opening; and an energy source for generating pressure vessel, wherein at a rest stage of the system, prior to activating the energy source, the fluid level within the pressure vessel and the expansion vessel exceeds at least one of the first and second openings and at least one of the third and fourth openings, and if the expansion vessel is sealed, the energy source is a heat source.

* * * * *